US009068424B2

(12) United States Patent
Steele et al.

(10) Patent No.: US 9,068,424 B2
(45) Date of Patent: Jun. 30, 2015

(54) OFFSHORE FLUID TRANSFER SYSTEMS AND METHODS

(75) Inventors: Graeme Steele, Tomball, TX (US); Douglas Paul Blalock, Katy, TX (US); Steve Eggert, Houston, TX (US); Chau Nguyen, Houston, TX (US); Paul Sheperd, Houston, TX (US); Trevor Smith, Spring, TX (US); David Wilkinson, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 360 days.

(21) Appl. No.: 13/451,426

(22) Filed: Apr. 19, 2012

(65) Prior Publication Data

US 2012/0273215 A1 Nov. 1, 2012

Related U.S. Application Data

(60) Provisional application No. 61/480,368, filed on Apr. 28, 2011.

(51) Int. Cl.

| | |
|---|---|
| ***E21B 7/12*** | (2006.01) |
| ***E21B 33/038*** | (2006.01) |
| ***E21B 34/04*** | (2006.01) |
| ***E21B 19/00*** | (2006.01) |

(52) U.S. Cl.

CPC ..... *E21B 33/038* (2013.01); *E21B 34/04* (2013.01); *E21B 19/004* (2013.01)

(58) Field of Classification Search

CPC ..... E21B 17/012
USPC ..... 166/345, 350, 367; 405/224.2, 224.3
See application file for complete search history.

(56) References Cited

U.S. PATENT DOCUMENTS

| | | | | | |
|---|---|---|---|---|---|
| 3,999,617 | A | * | 12/1976 | Ilfrey et al. | 175/7 |
| 4,138,751 | A | * | 2/1979 | Kentosh | 441/5 |
| 4,234,047 | A | | 11/1980 | Mott | |

(Continued)

FOREIGN PATENT DOCUMENTS

WO WO01/30646 5/2001

OTHER PUBLICATIONS

Hatton et al., "Recent Developments in Free Standing Riser Technology", 3rd Workshop on Subsea Pipelines, Dec. 3-4, 2002, Rio De Janeiro, Brazil, 22 pages.

*Primary Examiner* — Matthew Buck
*Assistant Examiner* — Aaron Lembo
(74) *Attorney, Agent, or Firm* — Jayne C. Piana

(57) ABSTRACT

A system for transferring fluids from a free-standing riser to a surface vessel comprises a first valve assembly including a first valve spool and a first isolation valve configured to control the flow of fluids through the first valve spool. In addition, the system comprises a second valve assembly releasably coupled to the first valve assembly with a hydraulically actuated connector. The second valve assembly includes a second valve spool and a second isolation valve configured to control the flow of fluids through the second valve spool. Further, the system comprises a deployment/retrieval rigging coupled to the first valve assembly and configured to suspend the first valve assembly and the second valve assembly from the surface vessel. Each isolation valve has an open position allowing fluid flow therethrough and a closed position restricting fluid flow therethrough, and each isolation valve is biased to the closed position.

27 Claims, 20 Drawing Sheets

(56) References Cited

U.S. PATENT DOCUMENTS

| | | | | | |
|---|---|---|---|---|---|
| 4,391,332 | A | * | 7/1983 | Fayren | 166/350 |
| 4,448,568 | A | * | 5/1984 | Gentry et al. | 405/168.3 |
| 4,646,840 | A | * | 3/1987 | Bartholomew et al. | 166/350 |
| 4,735,267 | A | * | 4/1988 | Stevens | 166/345 |
| 4,762,180 | A | | 8/1988 | Wybro et al. | |
| 4,878,694 | A | * | 11/1989 | Castel | 285/24 |
| 5,046,896 | A | * | 9/1991 | Cole | 405/195.1 |
| 5,549,164 | A | * | 8/1996 | Blandford | 166/344 |
| 5,794,700 | A | | 8/1998 | Pollack | |
| 5,941,310 | A | * | 8/1999 | Cunningham et al. | 166/345 |
| 6,042,303 | A | * | 3/2000 | Head | 405/195.1 |
| 6,082,391 | A | | 7/2000 | Thiebaud et al. | |
| 6,321,844 | B1 | | 11/2001 | Thiebaud et al. | |
| 6,415,828 | B1 | | 7/2002 | Duggal | |
| 6,558,215 | B1 | | 5/2003 | Boatman | |
| 6,612,369 | B1 | | 9/2003 | Rocha et al. | |
| 6,763,889 | B2 | * | 7/2004 | Rytlewski et al. | 166/338 |
| 6,854,930 | B2 | * | 2/2005 | Pionetti | 405/172 |
| 7,434,624 | B2 | | 10/2008 | Wilson | |
| 7,836,840 | B2 | | 11/2010 | Ehrhardt et al. | |
| 7,934,560 | B2 | * | 5/2011 | Roveri et al. | 166/345 |
| 8,403,065 | B2 | * | 3/2013 | Taylor et al. | 166/378 |
| 8,733,090 | B2 | * | 5/2014 | Coonrod et al. | 60/485 |
| 2007/0044972 | A1 | | 3/2007 | Roveri | |
| 2008/0166936 | A1 | | 7/2008 | Lindblade | |
| 2008/0196899 | A1 | | 8/2008 | Alliot | |
| 2008/0223583 | A1 | | 9/2008 | Roveri et al. | |
| 2010/0025044 | A1 | | 2/2010 | McKay et al. | |
| 2012/0305262 | A1 | * | 12/2012 | Ballard et al. | 166/363 |
| 2013/0269947 | A1 | * | 10/2013 | Shilling et al. | 166/345 |

* cited by examiner

OFFSHORE FLUID TRANSFER SYSTEMS AND METHODS

CROSS-REFERENCE TO RELATED APPLICATIONS

This application claims benefit of U.S. provisional patent application Ser. No. 61/480,368 filed Apr. 28, 2011, and entitled "Fluid Transfer Systems and Methods," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The invention relates generally to systems and methods for transferring fluids from subsea components to surface vessels. More particularly, the invention relates to systems and methods for transferring fluids from a subsea free-standing riser to a surface vessel.

2. Background of the Technology

Free-standing riser (FSR) systems are used during production and completion operations to transfer fluids from a subsea well to a surface vessel. Conventional free-standing risers include a rigid vertical conduit formed by an arrangement of steel pipes secured to the sea floor at its lower end with a foundation. The upper portion of the free-standing riser is positioned subsea, below the wave zone, and typically comprises an upper riser assembly. One or more tensioning buoys are coupled to the upper riser assembly to support the weight of the riser and maintain the riser in tension. Flexible flowlines or "jumpers" connect the upper riser assembly to a surface vessel, thereby enabling the flow of produced hydrocarbons from the riser to the vessel. The combination of a rigid riser section which extends vertically from the seafloor to an upper end below the wave zone, and a flexible section comprised of flexible flowlines extending from the top of the rigid section to a floating vessel on the surface is often referred to as "hybrid" risers.

Some conventional free-standing riser systems include connect/disconnect systems that enable a surface vessel to connect to and disconnect from the jumpers. For example, a surface vessel may be disconnected from a free-standing riser and moved to avoid a floating iceberg, hurricane, etc. However, such conventional connect/disconnect systems are tailored to a particular type of surface vessel and/or require specific hardware that may not be available on all vessels. Moreover, some conventional connect/disconnect systems take a relatively long period of time to connect and/or disconnect from the free-standing riser, which may be problematic in an emergency situation where a very quick disconnection is desirable without damaging hardware or discharging hydrocarbons into the surrounding sea.

Accordingly, there remains a need in the art for efficient fluid transfer systems (FTS) and methods for transferring hydrocarbon fluids between a subsea system such as a free-standing riser and a surface vessel. Such systems and methods would be particularly well-received if they provided a relatively quick connect/disconnect capability from the surface and could be operated with a variety of different vessels.

BRIEF SUMMARY OF THE DISCLOSURE

These and other needs in the art are addressed in one embodiment by a system for transferring fluids from a free-standing riser to a surface vessel. In an embodiment, the system comprises a first valve assembly including a first valve spool having an upper end, a lower end opposite the upper end, a flow bore extending between the upper end and the lower end, and a first isolation valve configured to control the flow of fluids through the flow bore of the first valve spool. The flow bore of the first valve spool has an outlet at the upper end configured to supply fluids to the surface vessel and an inlet at the lower end. In addition, the system comprises a second valve assembly releasably coupled to the first valve assembly with a hydraulically actuated connector. The second valve assembly includes a second valve spool having an upper end, a lower end opposite the upper end, a flow bore extending between the upper end and the lower end, and a second isolation valve configured to control the flow of fluids through the flow bore of the second valve spool. The flow bore of the second valve spool has an outlet at the upper end and an inlet at the lower end configured to receive fluids from the free-standing riser. Further, the system comprises a deployment/retrieval rigging coupled to the first valve assembly and configured to suspend the first valve assembly and the second valve assembly from the surface vessel. The flow bore of the second valve spool is in fluid communication with the flow bore of the first valve spool. Each isolation valve has an open position allowing fluid flow therethrough and a closed position restricting fluid flow therethrough. Each isolation valve is biased to the closed position.

These and other needs in the art are addressed in another embodiment by a method. In an embodiment, the method comprises (a) assembling a fluid transfer system on a surface vessel. The fluid transfer system includes a first valve assembly including a first valve spool with a hydraulically actuated first isolation valve and a second valve assembly releasably coupled to the first valve assembly with a hydraulically actuated connector. The second valve assembly includes a second valve spool with a second hydraulically actuated isolation valve. In addition, the method comprises (b) coupling a fluid transfer line extending from the vessel to the fluid transfer system. Further, the method comprises (c) coupling the fluid transfer system to a jumper extending from a free-standing riser. Still further, the method comprises (d) lowering the fluid transfer system through a moonpool in the surface vessel into the sea. Moreover, the method comprises (e) flowing hydrocarbon fluids from the free-standing riser through the jumper, the fluid transfer system, and the fluid transfer line to the vessel.

These and other needs in the art are addressed in another embodiment by a system for producing fluids from a subsea source to a surface vessel having a deck. In an embodiment, the system comprises a platform configured to be moveably coupled to the deck of the vessel. In addition, the system comprises a fluid transfer system configured to be suspended from the vessel with a deployment/retrieval rigging. The fluid transfer system includes a first valve assembly including a first valve spool with a first isolation valve and a second valve assembly releasably coupled to the first valve assembly with a hydraulically actuated connector. The second valve assembly includes a second valve spool with a second isolation valve. Each isolation valve has an open position allowing fluid flow through the valve assembly and a closed position restricting fluid flow through the valve assembly. Further, the system comprises a disconnect rigging coupled to the hydraulically actuated connector. The disconnect rigging is configured to mechanically disconnect the first valve assembly from the second valve assembly. Still further, the system comprises an umbilical including a plurality of hydraulic lines extending from the vessel to the fluid transfer system. Moreover, the system comprises a fluid transfer line extending from the vessel to the fluid transfer system.

Embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
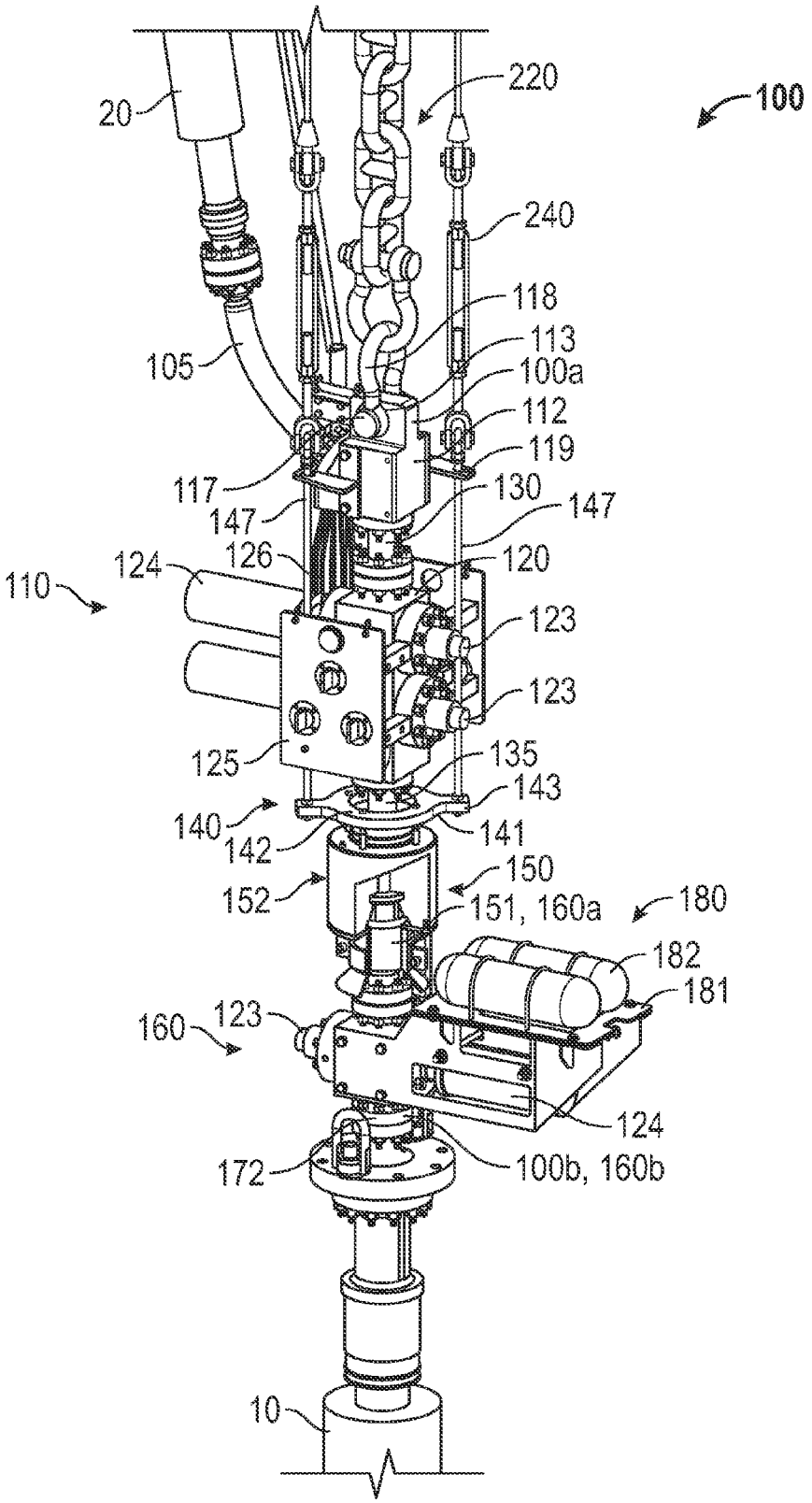
FIG. 1 is a perspective partial sectional view of an embodiment of fluid transfer system in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Figure 2:
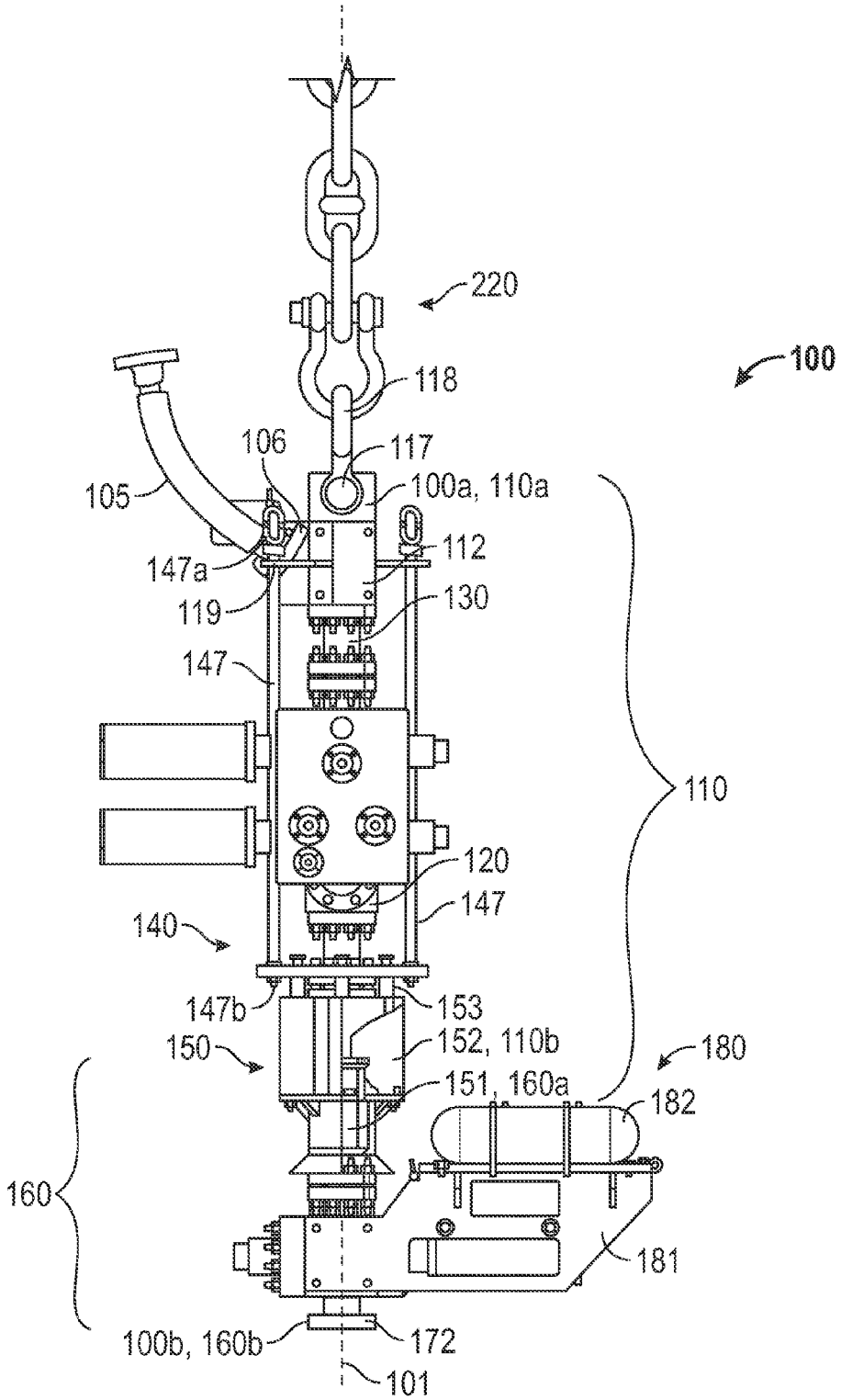
FIG. 2 is a front partial sectional view of the fluid transfer system of FIG. 1.

Referring now to FIGS. 1 and 2, an embodiment of a fluid transfer system 100 for producing hydrocarbons from a free standing riser (FSR) to a surface vessel is shown. In general, system 100 may be employed to transfer hydrocarbons from a FSR to any type of surface vessel including, without limitation, a drillship, a production or processing vessel, an offshore drilling or production platform, a bottom-founded offshore structure, a floating offshore structure, or a mobile offshore vessel. In FIG. 1, system 100 is positioned between a jumper 10 and a fluid transfer line 20. Jumper 10 is coupled to the upper end of the FSR and transfer line 20 is coupled to the processing equipment of a surface vessel. Thus, the FSR supplies hydrocarbons to system 100 via jumper 10, and system 100 supplies the hydrocarbons to the surface vessel via transfer line 20. Transfer line 20 may comprise any type of flexible fluid conduit suitable for use with hydrocarbons including, without limitation, Coflon® hose available from Technip USA Inc., of Houston, Tex.

System 100 has a central or longitudinal axis 101, a first or upper end 100*a*, and a second or lower end 100*b* opposite end 100*a*. In this embodiment, system 100 includes a first or upper valve assembly (UVA) 110 and a second or lower valve assembly (LVA) 160 coupled to UVA 110 with a releasable connector 150. As best shown in FIG. 1, a gooseneck 105 extends between UVA 110 and transfer line 20, thereby placing system 100 in fluid communication with line 20, and LVA 160 is coupled to jumper 10, thereby placing system 100 in fluid communication with jumper 10 and the FSR coupled thereto.

In this embodiment, connector 150 is a hydraulically actuated, mechanical connector. In general, connector 150 may comprise any suitable hydraulically actuated mechanical connector including, without limitation, the Cameron Choke & Kill Line Collet Connector available from Cameron International Corporation of Houston, Tex. or MIB fluid connectors available from MIB Italiana S.P.A. of Padova, Italy. Typically, such hydraulically actuated mechanical connectors comprise an upward-facing male mandrel or hub, labeled with reference numeral 151 herein, that is inserted into and releasably engages a mating downward-facing female collect connector, labeled with reference numeral 152 herein. In addition, some conventional hydraulically actuated mechanical connectors, such as the Cameron Choke & Kill Line Collet Connector, include a mechanical override disconnection apparatus in the collect connector that enables a mechanically actuated release of the connection as a backup to the hydraulic actuation system. This may be particularly beneficial in cases where the hydraulic actuation fails or is otherwise non-functional.

Figure 3:
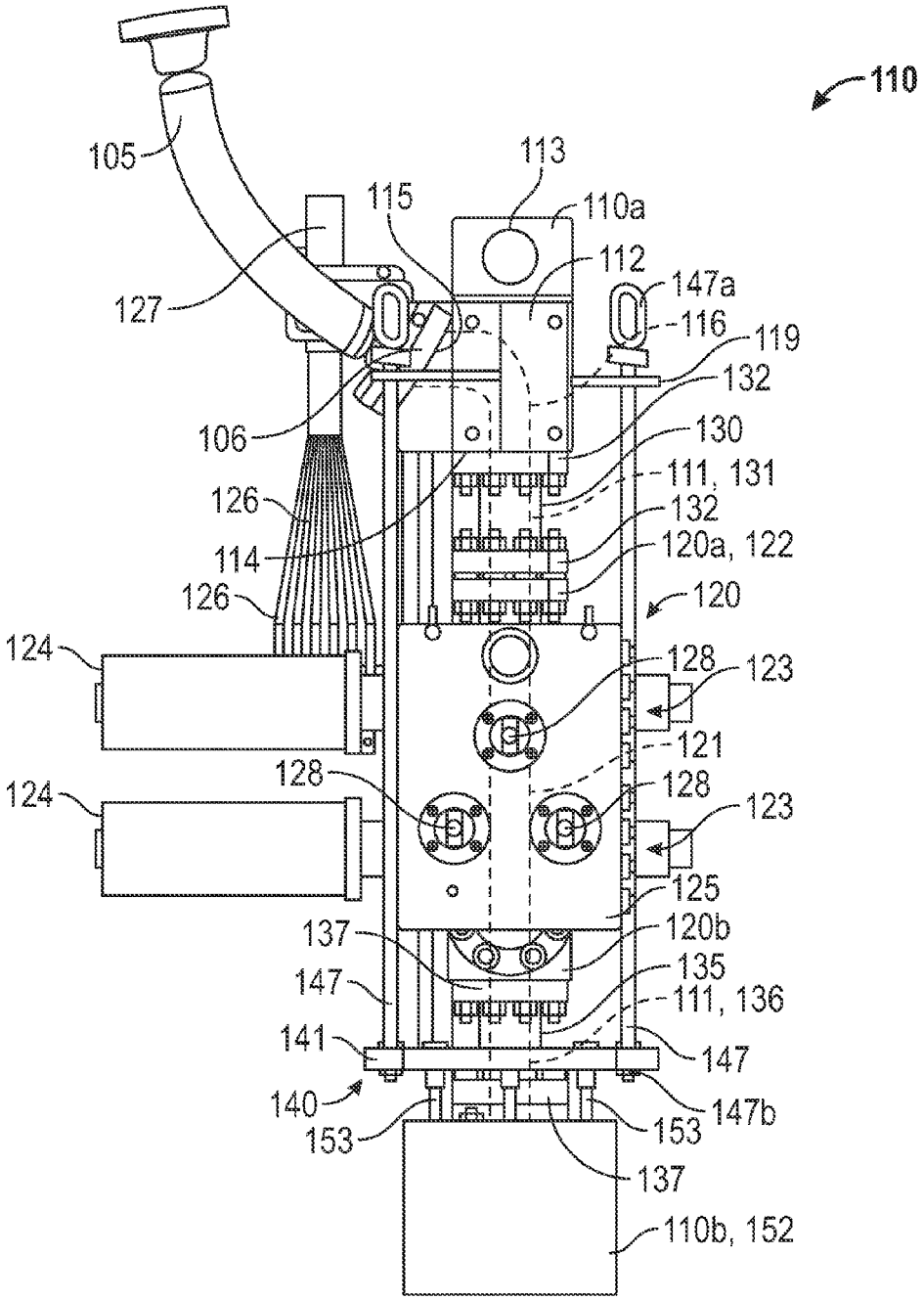
FIG. 3 is a front view of the upper valve assembly of FIG. 1.

Referring now to FIGS. 1-3, UVA 110 has a central or longitudinal axis coaxially aligned with axis 101, a first or upper end 110*a* coincident with end 100*a*, a second or lower end 110*b* opposite end 110*a*, and an inner flow passage 111 extending axially between ends 110*a, b*. In this embodiment, UVA 110 includes a block elbow 112 at upper end 110*a*, a valve spool 120 coupled to block elbow 112 with a first adapter spool 130, a collet connector 152 at end 110*b* coupled to valve spool 120 with a second adapter spool 135, and a mechanical release system 140. Inner flow passage 111 is defined by a series of interconnected bores and passages extending through block elbow 112, spools 130, 135, collet connector 152, and valve spool 120.

As best shown in FIG. 3, block elbow 112 includes an opening or hole 113, a planar lower surface 114, a planar side surface 115, and an inner flow bore or passage 116 extending between surfaces 114, 115. Flow bore 116 defines the upper portion of flow passage 111 of UVA 110. Gooseneck 105 includes a flange 106 at one end that is bolted to side surface 115, thereby placing passage 116 in fluid communication with gooseneck 105. As shown in FIGS. 1 and 2, hole 113 enables UVA 110 and system 100 to be coupled to a deployment/retrieval rigging 220. In particular, a pin 117 is slidingly received by hole 113 and couples block elbow 112 to a shackle 118, which is coupled to rigging system 200. As will be described in more detail below, rigging system 200 is used to assemble, move, deploy, and retrieve system 100.

Referring again to FIGS. 1-3, valve spool 120 is axially positioned between block elbow 112 and collet connector 152. In this embodiment, spool 120 has a first or upper end 120*a*, a second or lower end 120*b*, and a through bore or passage 121 extending axially between ends 120*a, b*. Passage 121 defines an intermediate portion of passage 111.

In this embodiment, valve spool 120 includes a pair of axially adjacent isolation valves 123 that control the flow of fluids through passages 111, 121. In particular, each valve 123 has an open position allowing fluid flow therethrough and a closed position restricting and/or preventing fluid flow therethrough. Since valves 123 are serially arranged, if either valve 123 is closed, fluid flow through passages 111, 121 is restricted and/or prevented. In this embodiment, each valve 123 is a fail-close isolation valve that is biased to the closed position, and must be actuated to transition to the open position. In particular, each valve 123 is a fail-close hydraulically actuated isolation gate valve. A hydraulic actuator 124 is coupled to each valve 123 to transition valves 123 to the open position, and maintain valves 123 in the open position. An example of a suitable valve and hydraulic actuator assembly that may be used for each valve 123 and associated actuator 124 is the MCS 3-1/16 in. 15 ksi Marine Choke & Kill Valve with the MCK actuator available from Cameron International Corporation of Houston, Tex.

Referring still to FIGS. 1-3, first adapter spool 130 couples block elbow 112 and valve spool 120, and second adapter spool 135 couples collet connector 152 to valve spool 120. Each adapter spool 130, 135 has a through bore 131, 136, respectively, extending between its upper and lower ends, and further, the ends of each spool 130, 135 comprise annular flanges 132, 137, respectively. Through bores 131, 136 define a portion of passage 111 extending through UVA 110. Flange 132 at the upper end of spool 130 is bolted to lower surface 114 of block elbow 112, and flange 132 at lower end of spool 130 is bolted to a mating flange 122 at upper end 120*a*, thereby coupling valve spool 120 to block elbow 112. In addition, flange 136 at the upper end of spool 135 is bolted to lower end 120*b*, and flange 136 at the lower end of spool 135 is bolted to collet connector 152, thereby coupling valve spool 120 to collet connector 152.

Referring still to FIGS. 1-3, UVA 110 also includes a mechanical release system 140 for mechanically actuating collet connector 152 to disengage and release hub 151. Mechanical release system 140 generally functions as a backup mechanism to disconnect UVA 110 and LVA 160 in the event collet connector 150 cannot be hydraulically actuated to disengage and release hub 151. In this embodiment, mechanical release system 140 includes an annular release plate 141 and a pair of release rods 147 extending axially upward from plate 141.

Release plate 141 includes a ring-shaped base 142 disposed about second adapter 135 and a pair of circumferentially-spaced arms 143 extending radially outward from base 142. A plurality of circumferentially-spaced mechanical release pins 153 extend axially upward from collet connector 152 and are coupled to base 142. Each rod 147 has a first or upper end 147*a* coupled to a mechanical disconnect rigging 240 (FIG. 1) and a second or lower end 147*b* coupled to one arm 143. Release pins 153 are configured to mechanically actuate collet connector 152 to disengage and release hub 151 when pulled axially upward. Thus, disconnect rigging 240 may be used to pull axially upward on rods 147 to lift release plate 141 and pins 153 coupled thereto axially upward, thereby mechanically actuating collet connector 152 to disengage and release hub 151. In this embodiment, each rod 147 extends through and slidingly engages a hole in a guide arm 119 extending radially from block elbow 112. Arms 119 maintain the orientation of rods 147 and guide the axial movement of rods 147.

Figure 4:
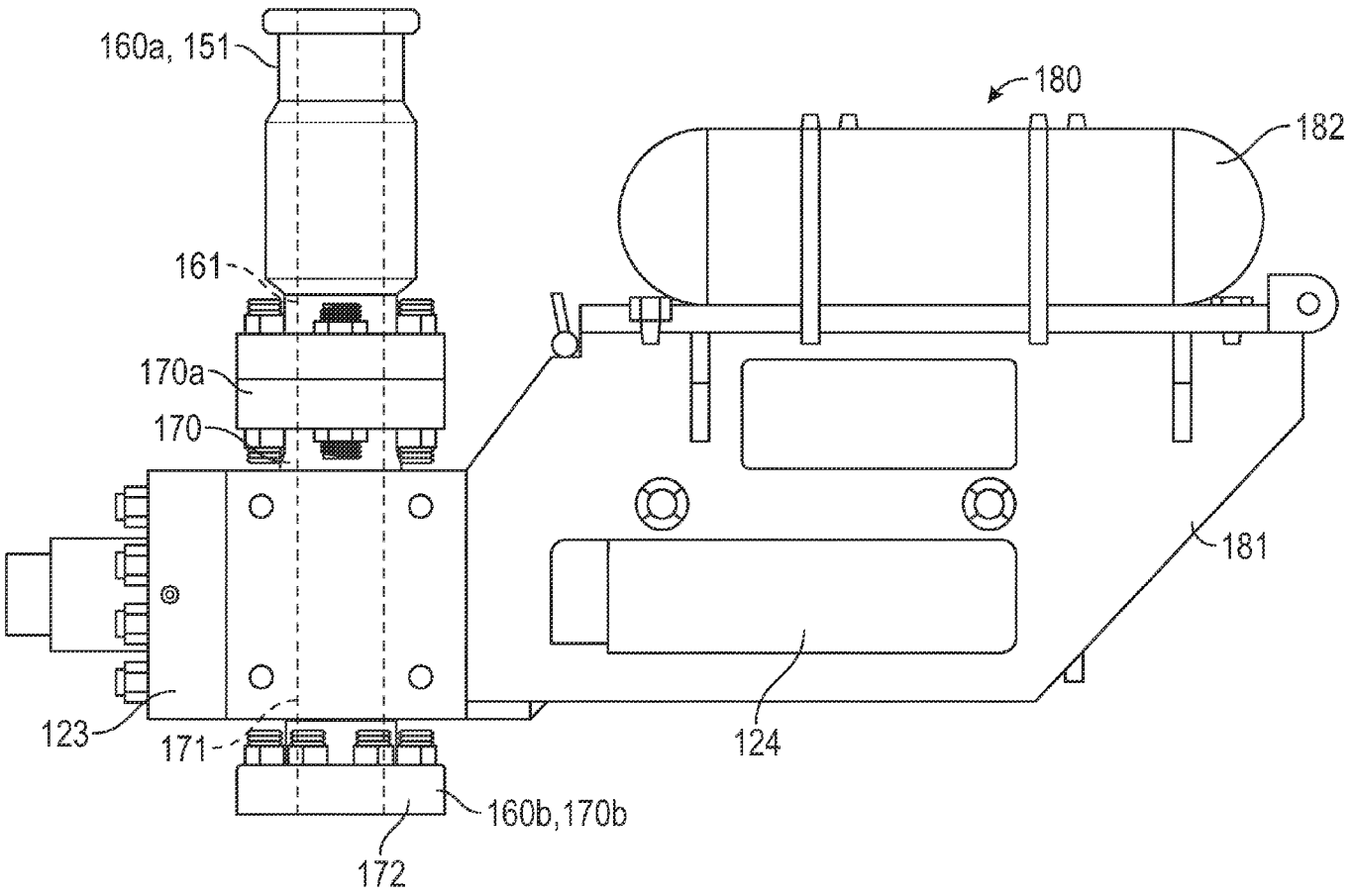
FIG. 4 is a front view of the lower valve assembly of FIG. 1.
Figure 5:
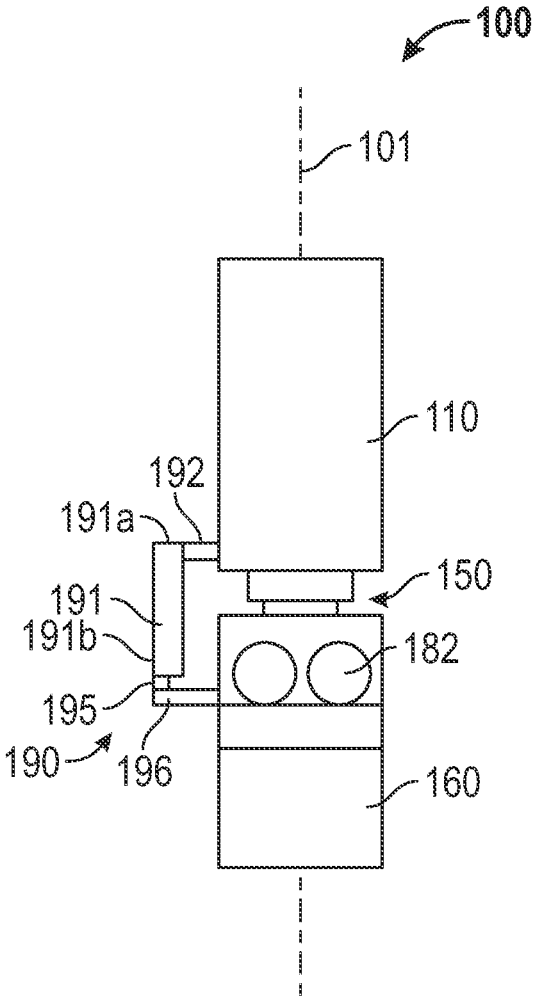
FIG. 5 is a schematic view of the fluid transfer system of FIG. 1 illustrating a device for severing the hydraulic lines connected to the actuator of the lower valve assembly of FIG. 1.

Referring now to FIGS. 1, 2, and 4, LVA 160 has a central or longitudinal axis coaxially aligned with axis 101, a first or upper end 160*a*, a second or lower end 160*b* coincident with end 100*b*, and an inner flow passage 161 extending axially between ends 160*a, b*. Flow passage 161 is coaxially aligned and in fluid communication with flow passage 111 of UVA 110. In this embodiment, LVA 160 includes hub 151 at upper end 160*a*, a valve spool 170 coupled to hub 151, and a valve actuation assist assembly 180 coupled to valve spool 170.

A test panel 125 is mounted to valve spool 120 and enables deck personnel to apply test pressure to passages 111, 161 to confirm that connector 150 between UVA 110 and LVA 160 has been correctly made-up and is leak tight. Panel 125 also enables passages 111, 161 to be vented and flushed to remove trapped pressure and/or hydrocarbons when disassembling UVA 110 and LVA 160 during a planned disconnect or recovery operation. Hydraulic power is provided to actuators 124 and collet connector 152 (to actuate valves 123 and collet connector 152) via hydraulic lines 126 housed within an umbilical 127 extending between a surface vessel and system 100.

Referring specifically to FIG. 4, valve spool 170 is axially positioned between hub 151 and lower end 160*b*. In this embodiment, spool 170 has a first or upper end 170*a* coupled to hub 151, a second or lower end 170*b* coincident with end 160*b*, and a through bore or passage 171 extending axially between ends 170*a, b*. Passage 171 defines a portion of passage 161. Lower end 170*b* comprises an annular flange 172.

In this embodiment, valve spool 170 includes an isolation valve 123 as previously described that controls the flow of fluids through passages 111, 171. Thus, if valve 123 is closed, fluid flow through passages 111, 171 is restricted and/or prevented. Further, as previously described, valve 123 is a fail-close isolation valve biased to the closed position, and must be actuated to transition to the open position. A hydraulic actuator 124 as previously described is coupled to valve 123 to transition valve 123 to the open position, and maintain valves 123 in the open position.

Hydraulic power is provided to actuator 124 (to actuate valve 123) via hydraulic lines 126 housed within umbilical 127 previously described. Valve actuation assist assembly 180 is coupled to valve spool 170 and provides additional hydraulic power to actuate valve 123 of UVA 160 to the closed position. In this embodiment, assist assembly 180 includes a support structure or frame 181 mounted to valve spool 170 and a plurality of hydraulic accumulators 182 mounted to frame 181. Accumulators 182 are coupled to actuator 124 and store pressurized hydraulic fluid that may be used to transition valve 123 between the open and closed positions.

Referring now to FIGS. 5 and 6A-6C, in this embodiment, fluid transfer system 100 also includes a hydraulic line severing system 190. For purposes of clarity, system 190 is only shown coupled to UVA 110 and LVA 160 in FIG. 5. System 190 is a passive mechanism for cutting the pair of hydraulic lines 126 extending from control panel 125 to actuator 124 of LVA 160 upon the subsea disconnection and separation of UVA 110 and LVA 160. For example, in the event of an emergency situation (e.g., hurricane), it may be necessary to disconnect UVA 110 from LVA 160, and pull UVA 110 to the surface while leaving LVA 160 coupled to jumper 10 subsea. The disconnection of UVA 110 from LVA 160 subsea (without intentionally severing lines 126 connected to actuator 124) may result in the uncontrolled breakage of hydraulic lines 126 connected to actuator 124 as control panel 125 is pulled to the surface along with UVA 110. Such uncontrolled breakage may permanently damage the connectors at the end of lines 126, which connect to actuator 124. This may necessitate a more complex subsea intervention to reconnect UVA 110 to LVA 160 as actuator 124 of LVA 160 may need to be serviced and/or replaced. However, system 190 functions to intentionally and controllably sever lines 126 connected to actuator 124 of LVA 160 upon the subsea disconnection and separation of UVA 110 and LVA 160.

In this embodiment, system 190 includes a housing 191 and a cutting member or blade 195 slidingly received by housing 191. Housing 191 is secured to UVA 110 with a connection member 192 and cutting member 195 is secured to LVA 160 with a connection member 196. In this embodiment, connection member 192 is an annular mounting bracket disposed about UVA 110 and connection member 196 is a rectangular block bolted to LVA 160. In general, connection members 192, 196 may be mounted to any suitable part of UVA 110 and LVA 160, respectively, provided members 192, 196 do not interfere with or impinge other components of system 100. Member 192 fixes the position and orientation of housing 191 relative to UVA 110, and thus, housing 191 does not move translationally or rotationally relative to UVA 110. Member 196 fixes the position and orientation of cutting member 195 relative to LVA 160, and thus, cutting member 195 does not move translationally or rotationally relative to LVA 160.

Figure 6A:
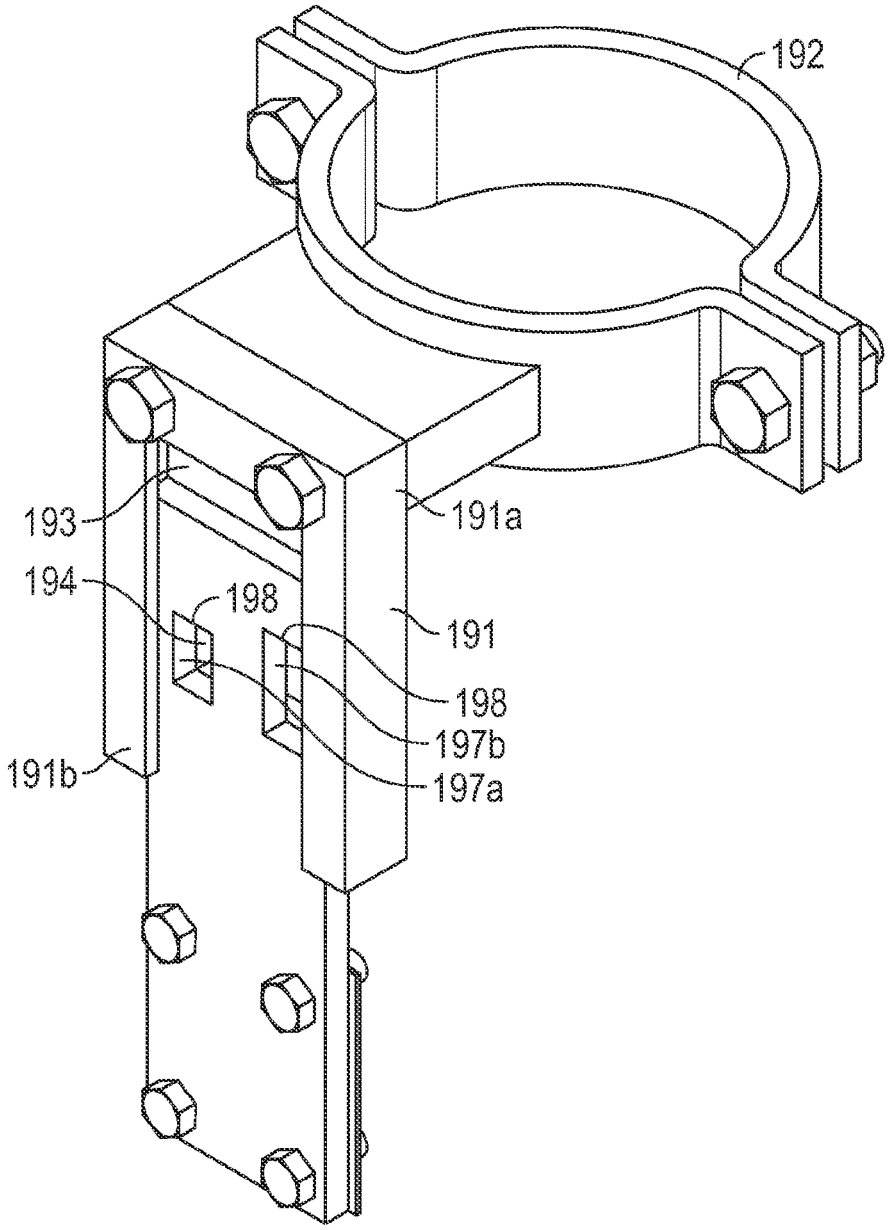
FIG. 6A is a perspective view of the hydraulic line severing device of FIG. 5.
Figure 6B:
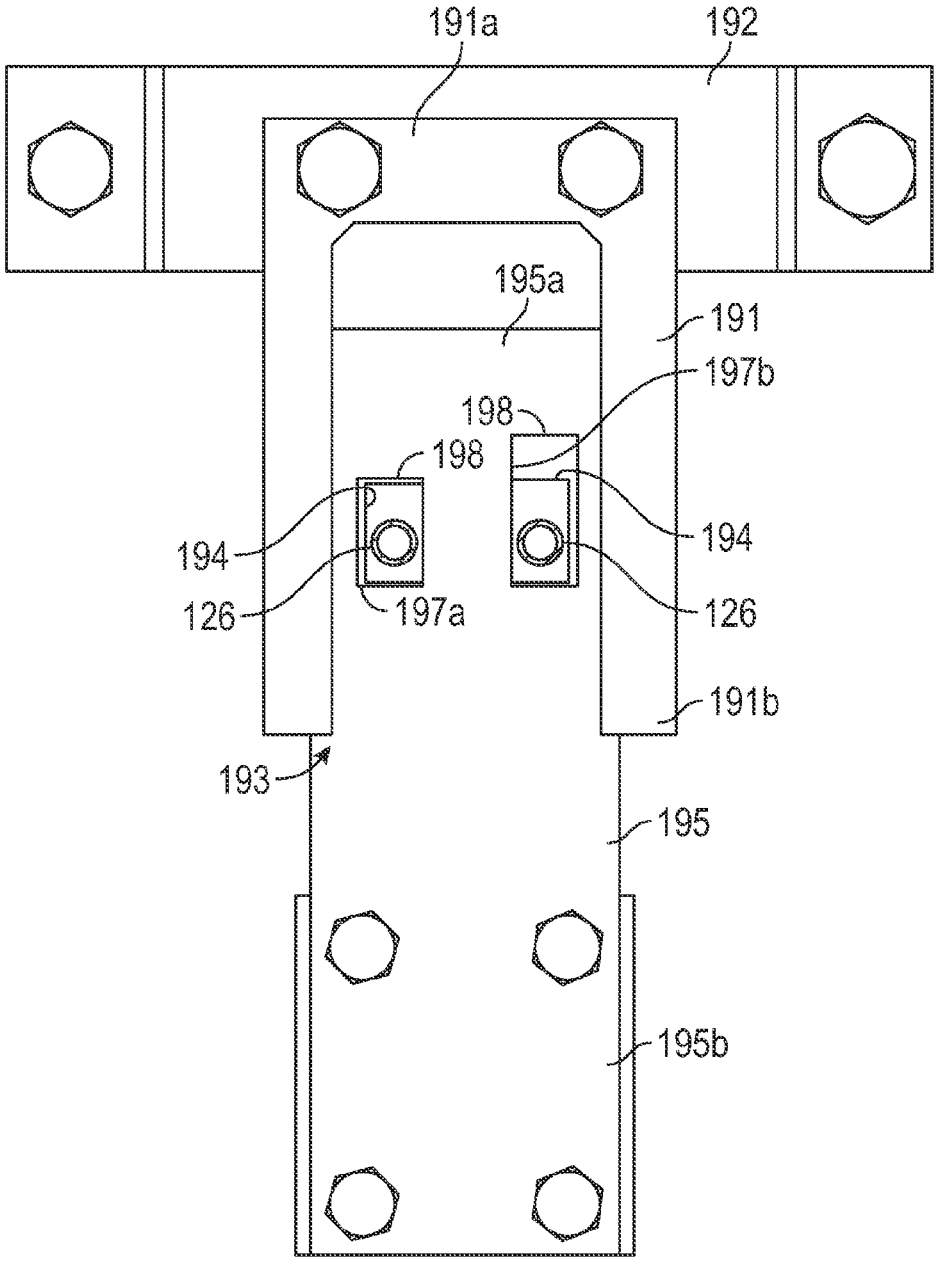
FIG. 6B is a front view of the hydraulic line severing device of FIG. 5.

Referring still to FIGS. 5 and 6A-6C, housing 191 has a first or upper end 191*a* attached to connection member 192, a second or lower end 191*b*, and a generally rectangular pocket or receptacle 193 extending axially upward from lower end 191*b*. Receptacle 193 is sized and shaped to slidingly receive cutting member 195. Housing 191 also includes a through hole or window 194 extending perpendicularly therethrough. Window 194 is positioned between ends 191*a, b* and is sized to receive hydraulic lines 126 as shown in FIG. 6B. Cutting member 195 is a rectangular plate having a first or upper end 195*a*, a second or lower end 195*b* attached to connection member 196, and a pair of through holes or windows 197*a, b* extending perpendicularly therethrough. Each window 197*a, b* is positioned between ends 195*a, b* and is sized to receive one hydraulic line 126. The upper edge of each window 197*a, b* comprises a beveled cutting blade 198 designed to cut hydraulic line 126 extending therethrough. As best shown in FIG. 6B, window 197*b* is longer (i.e., has a greater height) than window 197*a*.

Figure 6C:
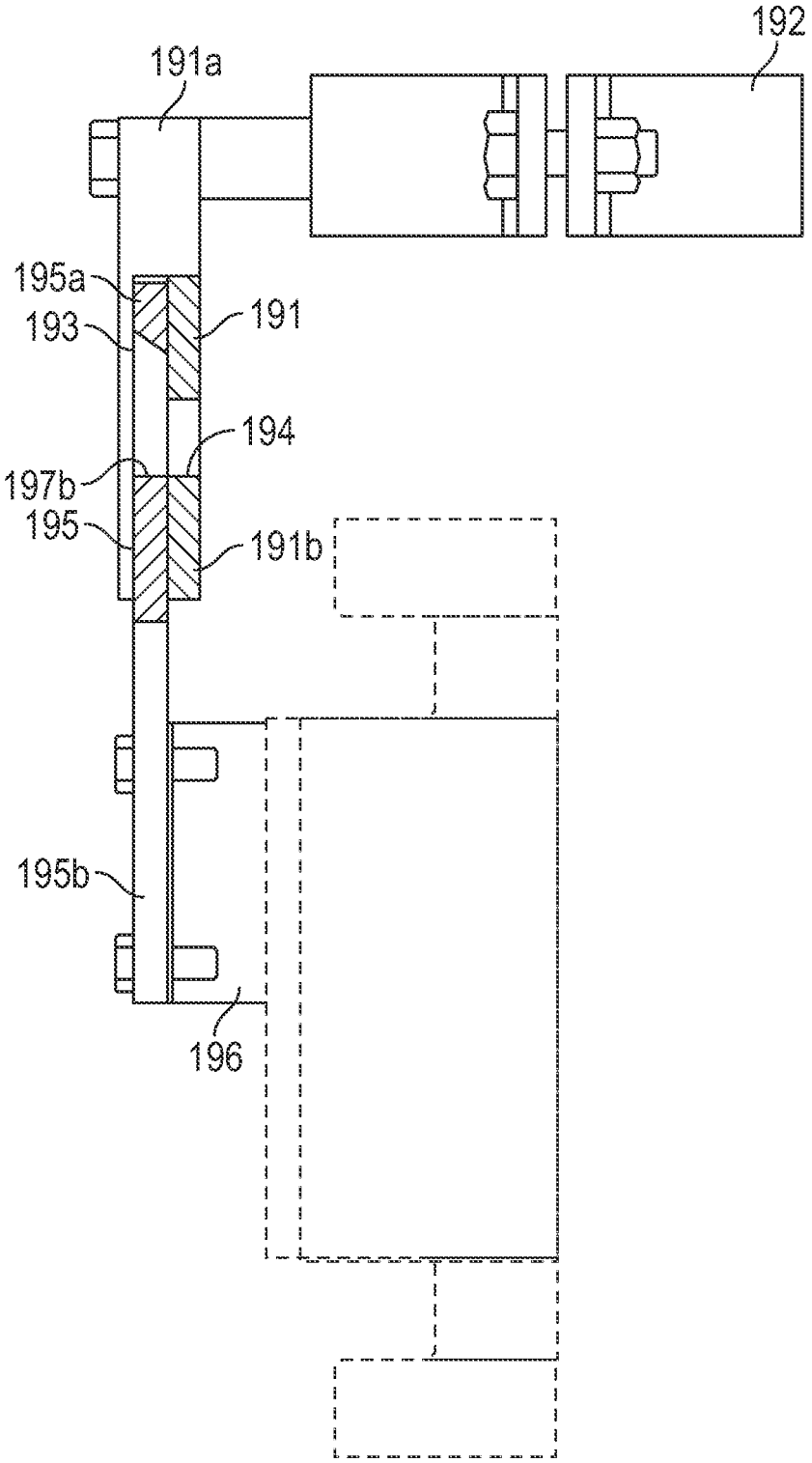
FIG. 6C is a partial cross-sectional side view of the hydraulic line severing device of FIG. 5.

Housing 191 and cutting member 195 are sized, positioned, and oriented such that during makeup of connector 150 cutting member 195 is slidingly received by housing 191 and windows 197*a, b* come into alignment with window 194 as shown in FIGS. 6B and 6C. However, upon disengagement of hub 151 and collect connector 152, and the subsequent axial separation of UVA 110 and LVA 160, cutting member 195 is axially pulled from housing 191. During assembly of system 100, following make-up of connector 150, two hydraulic lines 126 extending from control panel 125 are routed through aligned windows 194, 197*a, b* and connected to actuator 124 of LVA 160—one line 126 extends through aligned windows 194, 197*a*, and the other line 126 extends through aligned windows 194, 197*b*. In particular, hydraulic line 126 that operates to open valve 123 of LVA 160 via actuator 124 is positioned through window 197*a*, and hydraulic line 126 that operates to close valve 124 of LVA 160 via actuator 124 is positioned through window 197*b*.

Once lines 126 are disposed through windows 194, 197*a, b*, the axial separation of UVA 110 and LVA 160 results in housing 191 moving axially upward relative to cutting member 195, thereby moving windows 197*a, b* out of alignment with window 194. Lines 126 disposed in windows 194, 197*a, b* are initially compressed and then sheared by blades 198 as member 195 is pulled from receptacle 193. Thus, in the event of an emergency subsea disconnection of UVA 110 and LVA 160, lines 126 connected to actuator 124 of LVA 160 are severed, thereby enabling valve 123 of LVA 160 to automatically bias to the closed position and restricted and/or prevent fluid flow through passage 161. Due to the difference in the axial length of windows 197*a, b*, as housing 191 and cutting member 195 are pulled apart, the hydraulic "open" line 126 is severed first, and the hydraulic "closed" line 126 is severed second. This sequencing in the cutting of lines 126 limits the loads on blade 195 and speeds the closure of valve 123 of LVA 160.

Figure 7:
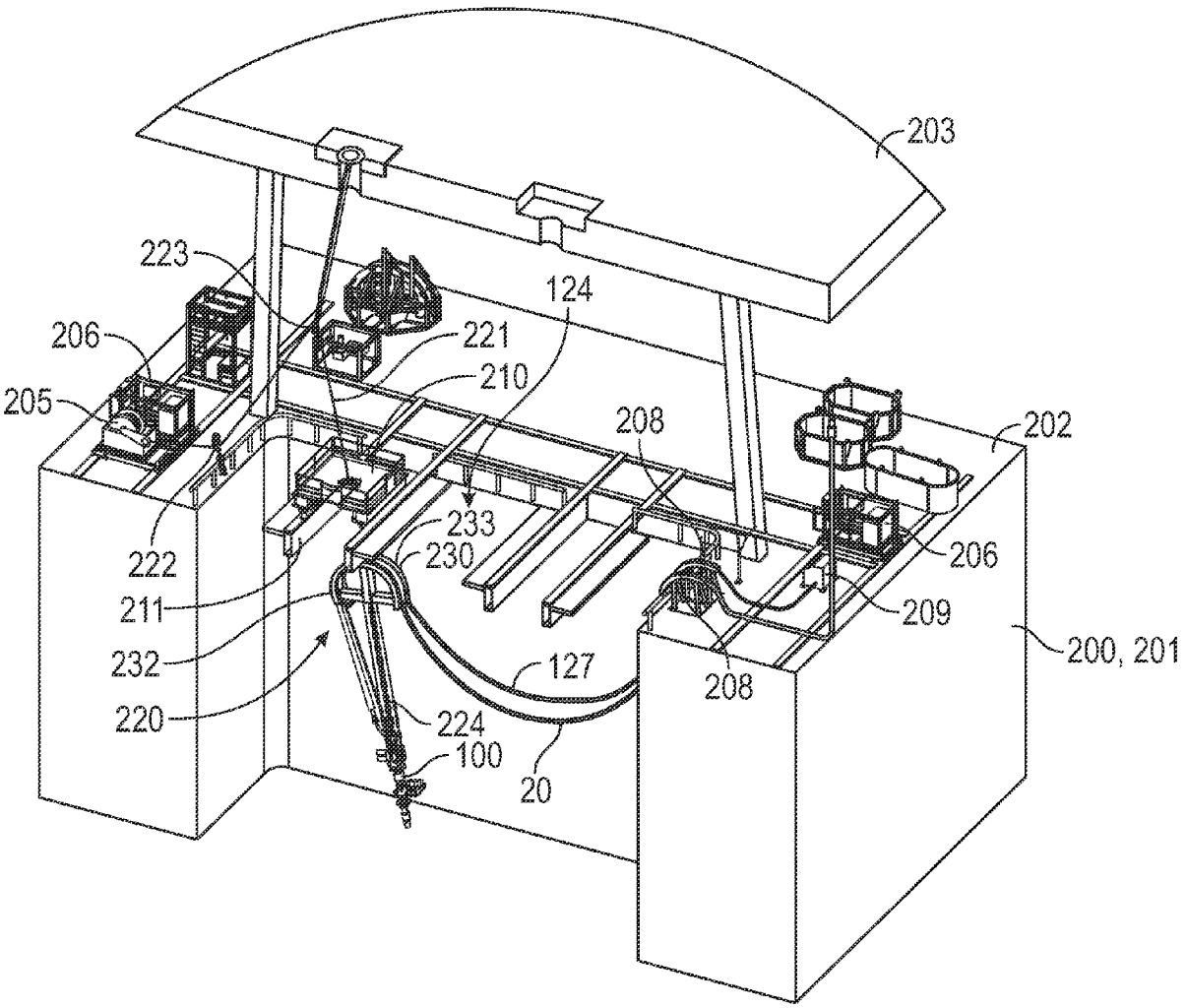
FIG. 7 is a perspective view of the fluid transfer system of FIG. 1 deployed subsea from a surface vessel.
Figure 8:
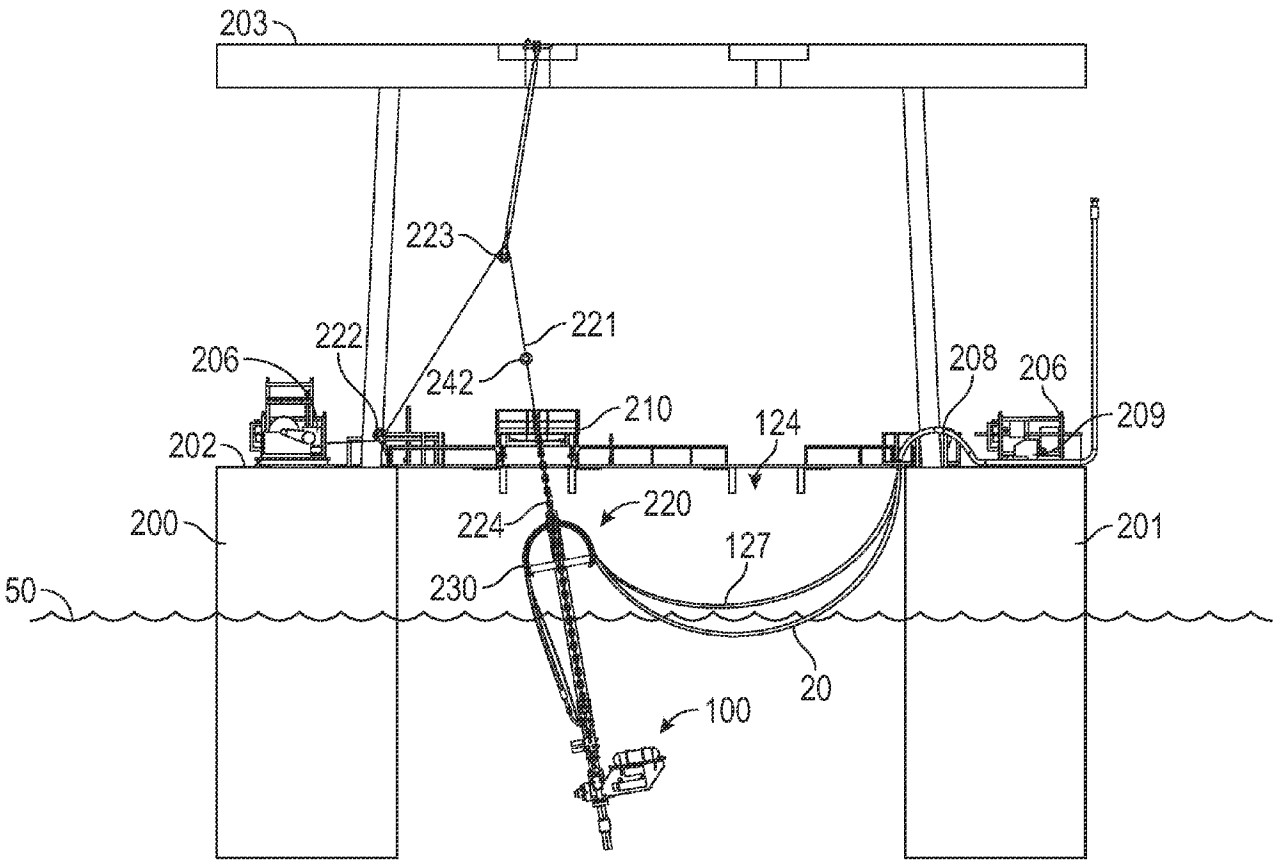
FIG. 8 is a front view of the fluid transfer system of FIG. 1 deployed subsea from the surface vessel of FIG. 7.

Referring now to FIGS. 7 and 8, fluid transfer system 100 is shown deployed subsea for the transfer of hydrocarbon fluids from jumper 10 to a vessel 200. Vessel 200 includes a hull 201, a lower deck 202, an upper deck 203, and a moonpool 204 extending vertically through lower deck 202 and hull 201 to the sea surface 50. A winch 205 and a pair of hydraulic power units (HPU) 206 are disposed on deck 202. As will be described in more detail below, winch 205 is used to deploy and retrieve system 100 using deployment/retrieval rigging 220. In this embodiment, winch 205 is a hydraulic winch powered by one HPU 206, however, in general, winch 205 may comprise any suitable of winch known in the art, such as a hydraulic winch, a pneumatic winch, or electric winch. Moreover, in other embodiments, the winch (e.g., winch 205) may be powered a ship-based power unit, such as a ship-based hydraulic, pneumatic or electrical device. The other HPU 206 supplies pressurized hydraulic fluid to hydraulic lines 126 of umbilical 127, which extends from deck 202 to system 100. A control system 209 on deck 202 operates and controls the application of pressurized hydraulic fluid to lines 126. Fluid transfer line 20 previously described is coupled to gooseneck 105 and extends to deck 202, thereby flowing produced hydrocarbons from system 100 to vessel 200 for processing, storage, offloading or combinations thereof. Umbilical 127 and transfer line 20 are each supported on deck 202 with an arcuate deck saddle 208. Although vessel 200 may comprise any suitable vessel for receiving produced hydrocarbon fluids from system 100, in this embodiment, vessel 200 is a drillship and upper deck 203 comprises a rotary table.

Figure 9A:
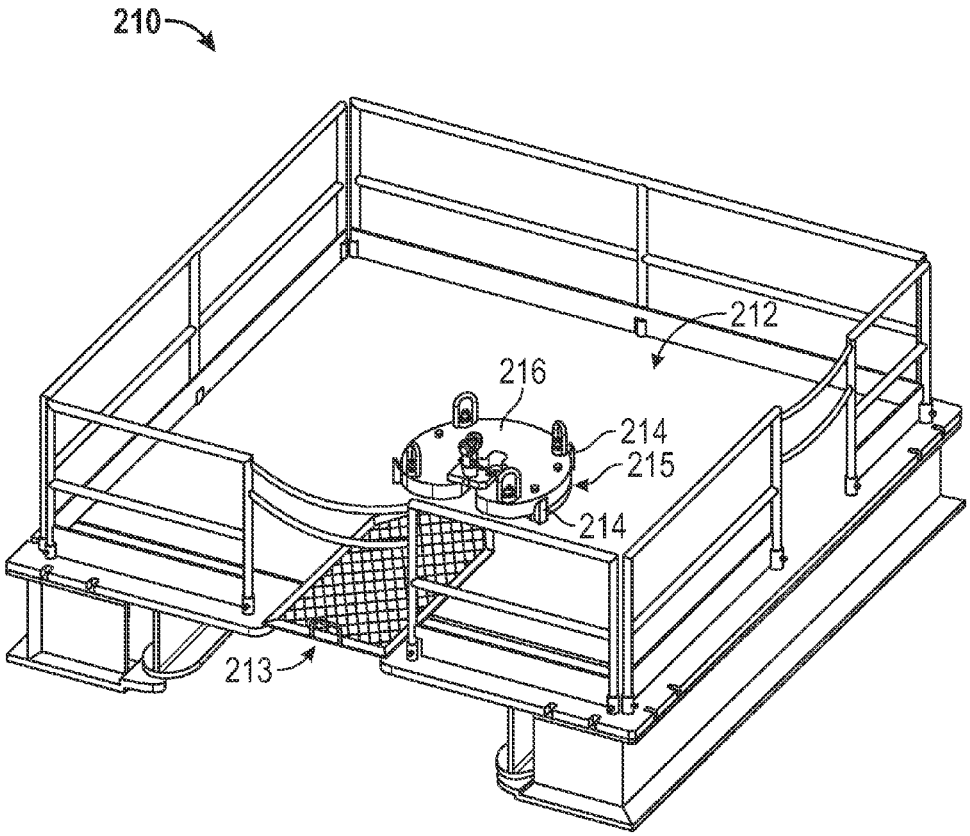
FIG. 9A is an enlarged perspective view of the platform of FIG. 7.
Figure 9B:
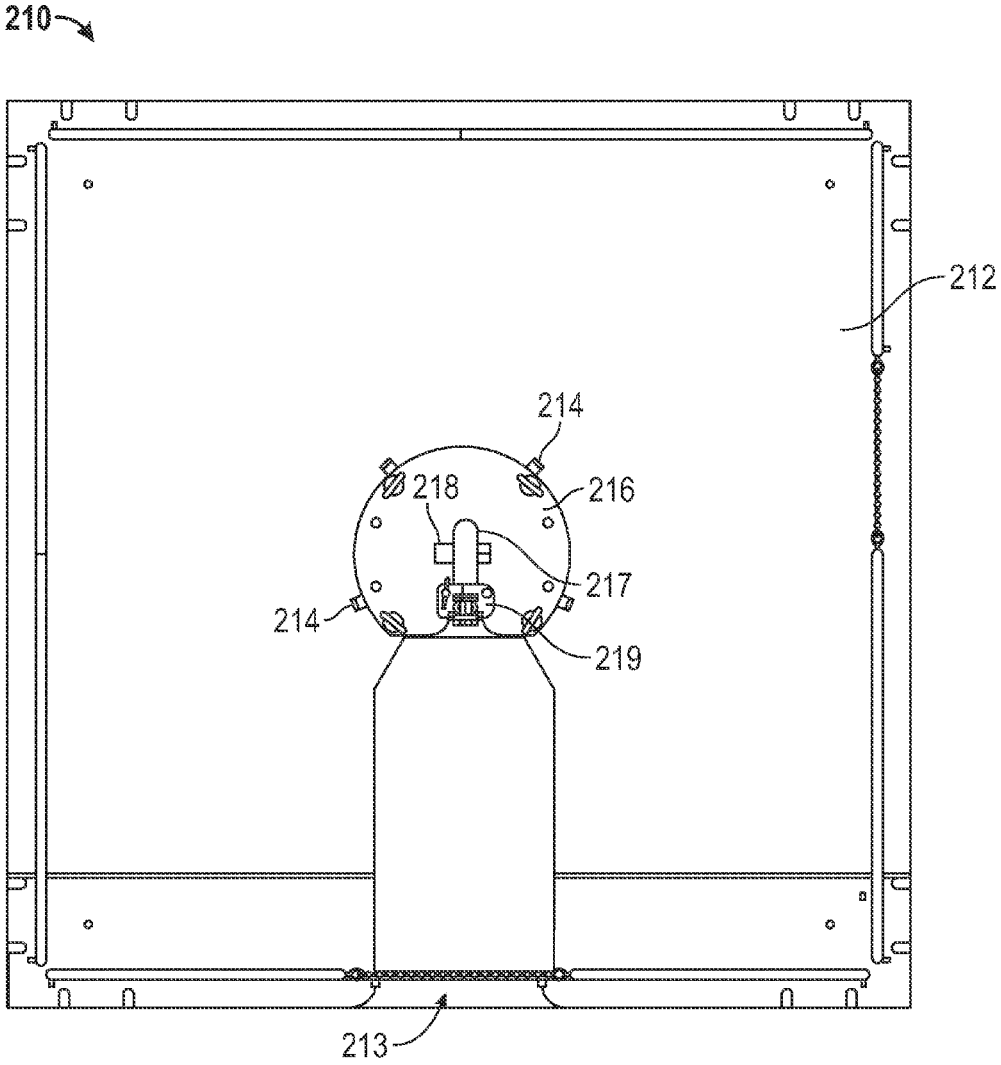
FIG. 9B is a top view of the platform of FIG. 7.
Figure 9C:
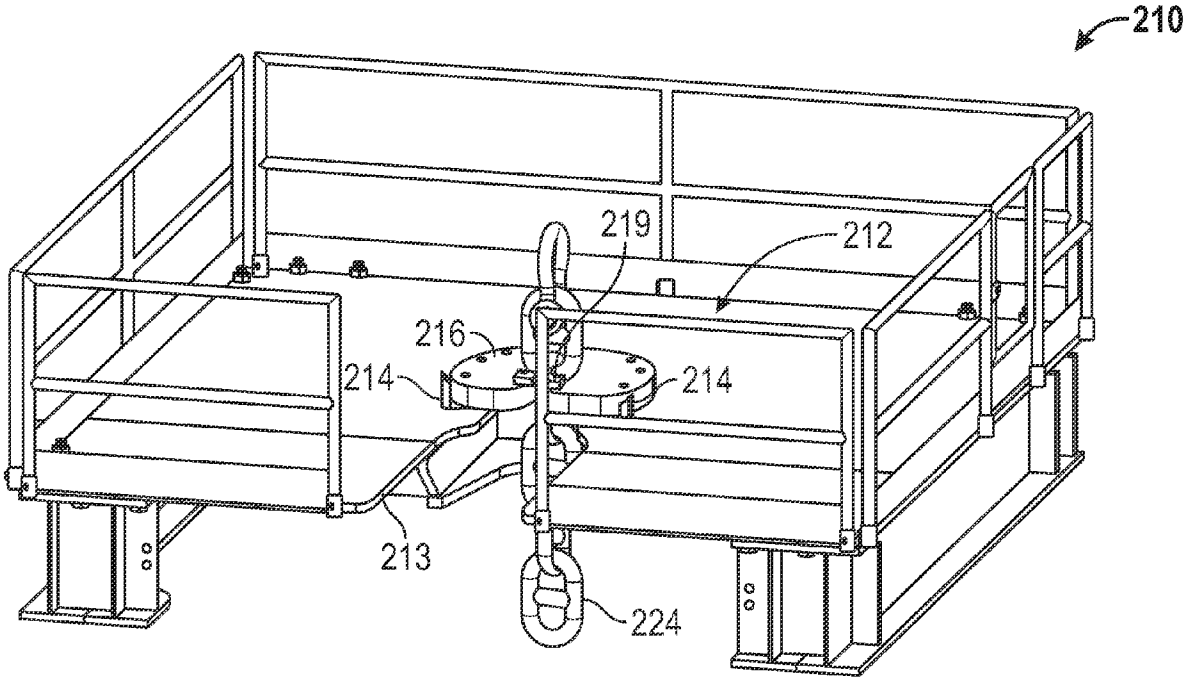
FIG. 9C is an enlarged perspective view of the platform of FIG. 7 supporting the chain of the deployment/retrieval rigging of FIGS. 7 and 8.

A platform 210 is supported over moonpool 204 with a pair of elongate rigid supports 211 that extend across moonpool 204 (i.e., with both ends secured to deck 202). In this embodiment, supports 211 are I-beams extending across deck 202 over moonpool 204. Platform 210 is moveably coupled to supports 211 such that platform 210 may be moved back-and-forth along supports 211 (i.e., parallel to supports 211) between a first position disposed over deck 202 and a second position disposed over moonpool 204. As best shown in FIGS. 9A-9C, platform 210 comprises a deck 212 including a receiving slot 213 extending from the leading edge of deck 212 to center of deck 212. Thus, slot 213 has an open outer end at the edge of deck 212 and a terminal inner end in the center of deck 212. A plurality of guide members 214 are disposed about the inner end of slot 213 and extend vertically upward from deck 212. Guide members 214 define a receptacle 215 on deck 212 that receives additional components used during the deployment and operation of system 100. For example, in FIGS. 9A-9C, a C-plate 216 is seated within receptacle 215 and in FIG. 13, a landing flange 332 is seated within receptacle 215.

Referring again to FIGS. 7 and 8, system 100 is positioned below the sea surface 50 and suspended from deployment/retrieval rigging 220, which extends through moonpool 204. Deployment/retrieval rigging 220 is operated with winch 205, and in this embodiment, includes a winch line or cable 221 mounted to winch 205, a deck sheave 222 secured to lower deck 202, a suspended sheave 223 hung from upper deck 203, a chain 224, and a support assembly 230. Line 221 extends from winch 205 around sheaves 222, 223 and between supports 211 to chain 224. The end of line 221 is releasably attached to the upper end of chain 224 with a shackle, and the lower end of chain 224 is releasably attached to system 100 with shackle 118 previously described. Thus, by rotating winch 205 in one direction, system 100 may be lowered relative to platform 210 and deck 202, and by rotating winch 205 in the opposite direction, system 100 may be raised relative to platform 210 and deck 202. For most applications, winch line 221 preferably has a length of about 2000 ft. (~610 meters).

Referring now to FIGS. 7, 8, 10, and 11, support assembly 230 is secured to chain 224 and includes a base member 231, an arcuate umbilical support member 232 coupled to base member 231, and an arcuate transfer line support member 233 coupled to base 231. Support member 233 is positioned behind support member 232 in FIGS. 8, 10, and 11. Base member 231 is a linear having an upper end 231*a*, a lower end 231*b*, and a through passage 234 extending between ends 231*a, b*. Chain 224 extends through passage 234. A mounting bracket 235 connected to each end 231*a, b* is securely attached to chain 224, thereby preventing support assembly 230 from moving downward along chain 224. Supports 232, 233 are coupled to opposite sides of base member 231. In this embodiment, each support members 232, 233 comprises an generally semi-circular saddle having a recessed upper surface that receives and routes umbilical 127 and transfer line 20, respectively. Support members 232, 233 define a bend radius of umbilical 127 and transfer line 20, respectively, that is sufficient to prevent umbilical 127 and transfer line 20 from kinking or being damaged.

Line 221 and chain 224 support system 100 during deployment and retrieval of system 100 (i.e., while raising and lowering system 100). However, during fluid transfer operations (i.e., after system 100 is deployed subsea), system 100 is supported by chain 224 and platform 210. In particular, as shown in FIGS. 7, 8, and 9C, once system 100 is disposed at the appropriate depth for fluid transfer operations, platform 210 is advanced over moonpool 204, C-plate 216 is seated in receptacle 215, and chain 224 is seated in C-plate 216. As best shown in FIG. 9B, C-plate 216 includes an access slot 217 aligned with slot 213, and extending from the perimeter of C-plate 216 to the center of C-plate 216. A recess 218 in C-plate 216 is oriented perpendicular to slot 217 and crosses slot 217 proximal its inner/terminal end. Slot 217 is sized and shaped to receive a link of chain 224 that is aligned therewith, but prevent a link oriented perpendicular thereto from passing therethrough. Thus, with system 100 disposed at the desired depth subsea, platform 210 can be moved over moonpool 204 to receive chain 224 through slots 213, 217. With chain 224 extending substantially vertically through the inner/terminal end of slots 213, 217, winch 205 slightly lowers system 100 to seat a link of chain 224 oriented perpendicular to slot 217 within recess 218 as shown in FIG. 9C, thereby transferring the weight of system 100 from line 221 to platform 210. To ensure chain 224 remains seated in recess 218 during production operations, a restriction plate or member 219 is mounted to C-plate 216 and extends across slot 217 to prevent chain 224 from inadvertently passing through and exiting slot 217. Once the load of system 100 is transferred from line 221 to platform 210, line 221 can be disconnected from chain 224 for the remainder of the fluid transfer operations. It should also be appreciated that once chain 224 is seated in C-plate 216 and is supported by platform 210 for fluid transfer operations, the moderate flexibility of chain 224 enables weather-vaning of vessel 200.

Figure 10:
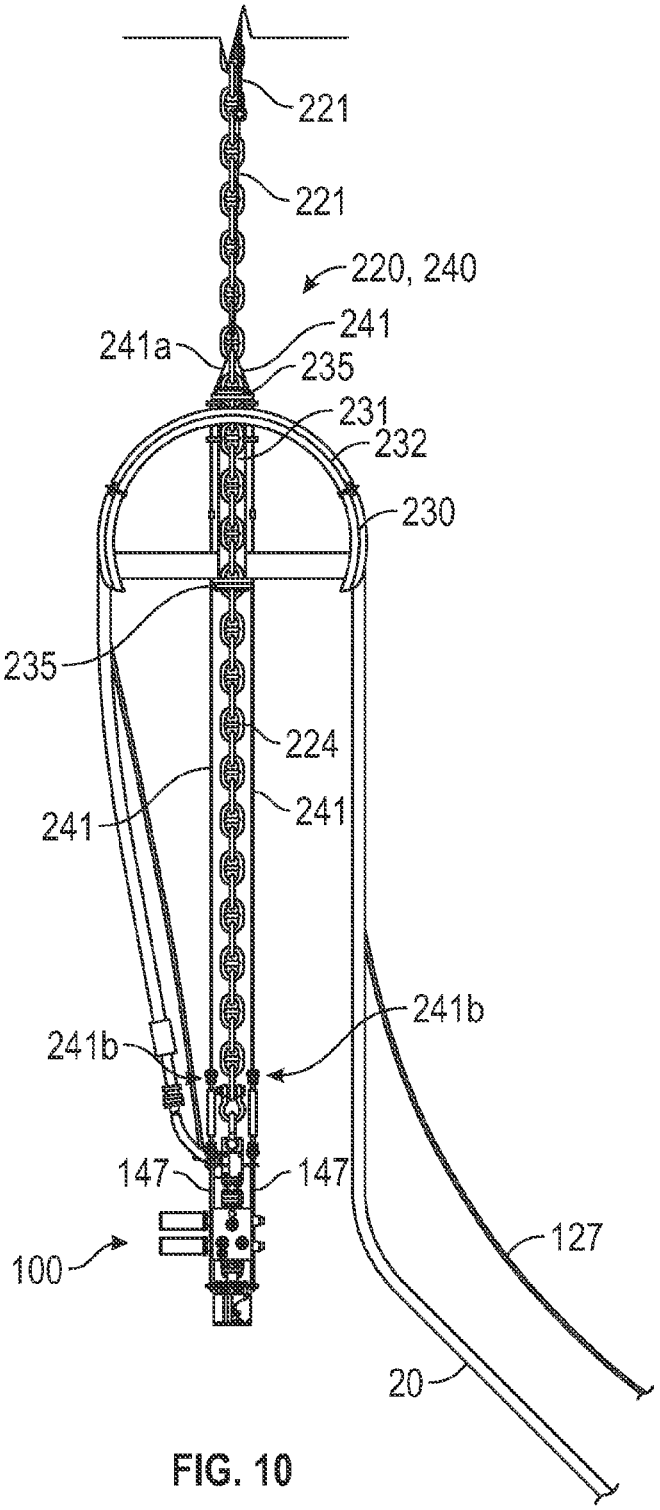
FIG. 10 is a front view of the deployment/retrieval rigging of FIG. 7 coupled to the upper valve assembly of FIG. 1.
Figure 11:
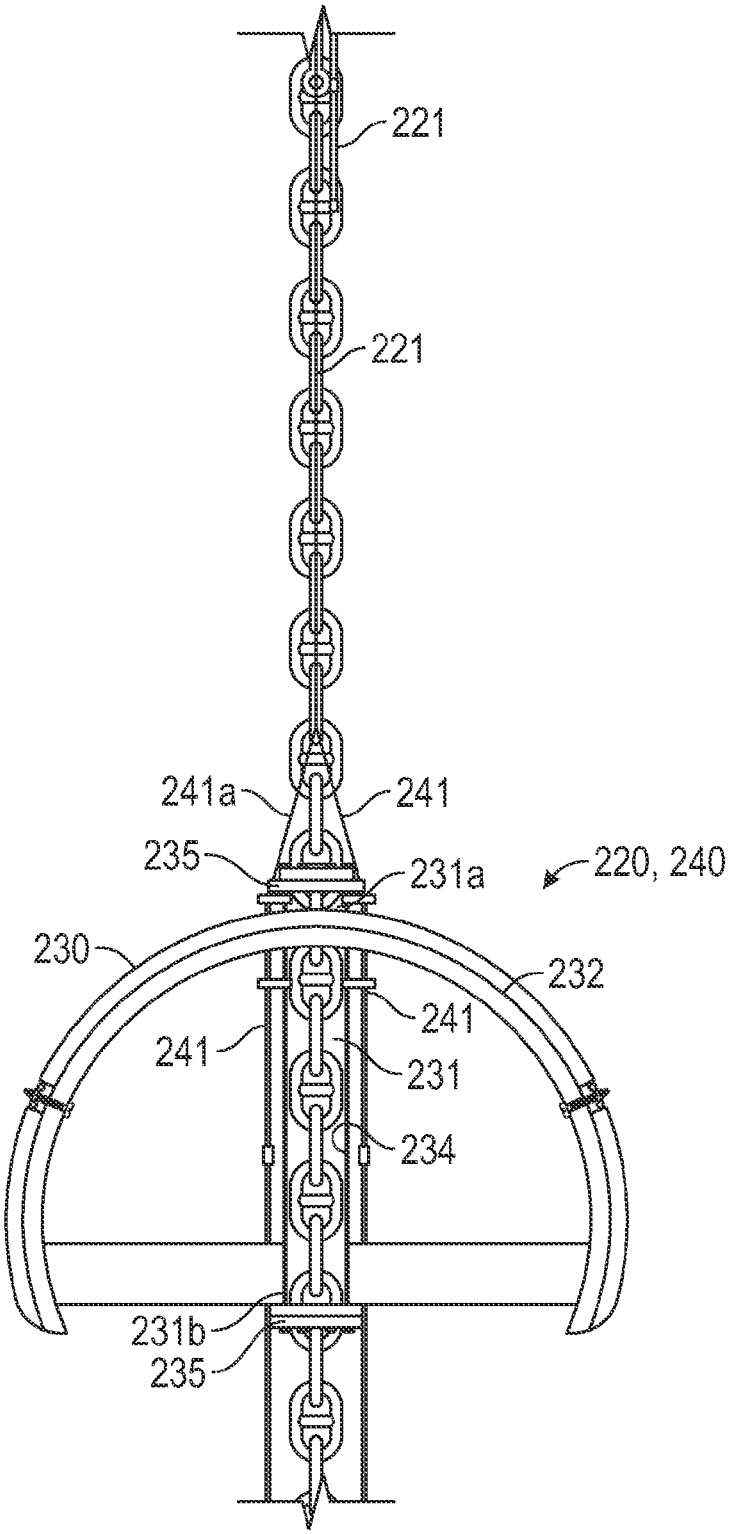
FIG. 11 is an enlarged front view of the deployment/retrieval rigging of FIG. 7.

Mechanical disconnect rigging 240 is also shown in FIGS. 10 and 11. As previously described, disconnect rigging 240 is used to pull rods 147 upward to lift release plate 141 and pins 153 coupled thereto, thereby mechanically releasing collet connector 152 from hub 151. In this embodiment, disconnect rigging 240 includes a pair of wirelines or cables 241 extending between line 221 (following its disconnection from chain 224) and rods 147. More specifically, each wireline 241 has an upper end 241 a coupled to the end of line 221 and a lower end 242*b* coupled to one rod 147. In this embodiment, wirelines 241 extend through and slidingly engage a plurality of guide members 236 extending laterally from base member 231 of support assembly 230. With chain 224 seated in C-plate 216 and platform supporting the weight of system 100, and line 221 connected to wirelines 241, winch 205 and line 221 can be used to pull wirelines 241, rods 147, plate 141, and pins 153 upward to mechanically actuating collet connector 152 to disengage and release hub 151. As best shown in FIG. 8, as an added safety feature, this embodiment also includes a stopper 242 securely mounted to line 221 above platform 210. Thus, in the event chain 224 breaks, system 100 begins to sink, and winch 205 is not connected to line 221 or is otherwise unable to apply tension to line 221, stopper 221 will engage a slot in deck 212 through which line 221 passes, thereby enabling the weight of system 100 to mechanically actuate collet connector 152 to disengage and release hub 151 via line 221, wirelines 241, rods 147, plate 141, and pins 153.

Thus, in this embodiment, collet connector 152 can be mechanically actuated to disengage and release hub 151 by pulling upward on line 221 with winch 205 or by the weight of system 100 in the event chain 224 breaks and system 100 begins to sink. In other embodiments, a linear actuator may be used to mechanically actuate the collet connector (e.g., collet connector 152) to disengage and release the hub (e.g., hub 151). For instance, the linear actuator may have a lower end connected to wirelines 241 and an upper end connected to support assembly or shackle connecting chain 224 to line 221 (provided line 221 has not been disconnected from chain 224). Thus, when the linear actuator is actuated to linearly contract, wirelines 241, rods 147, plate 141, and pins 153 are pulled upward to mechanically actuating collet connector 152 to disengage and release hub 151.

Figure 12:
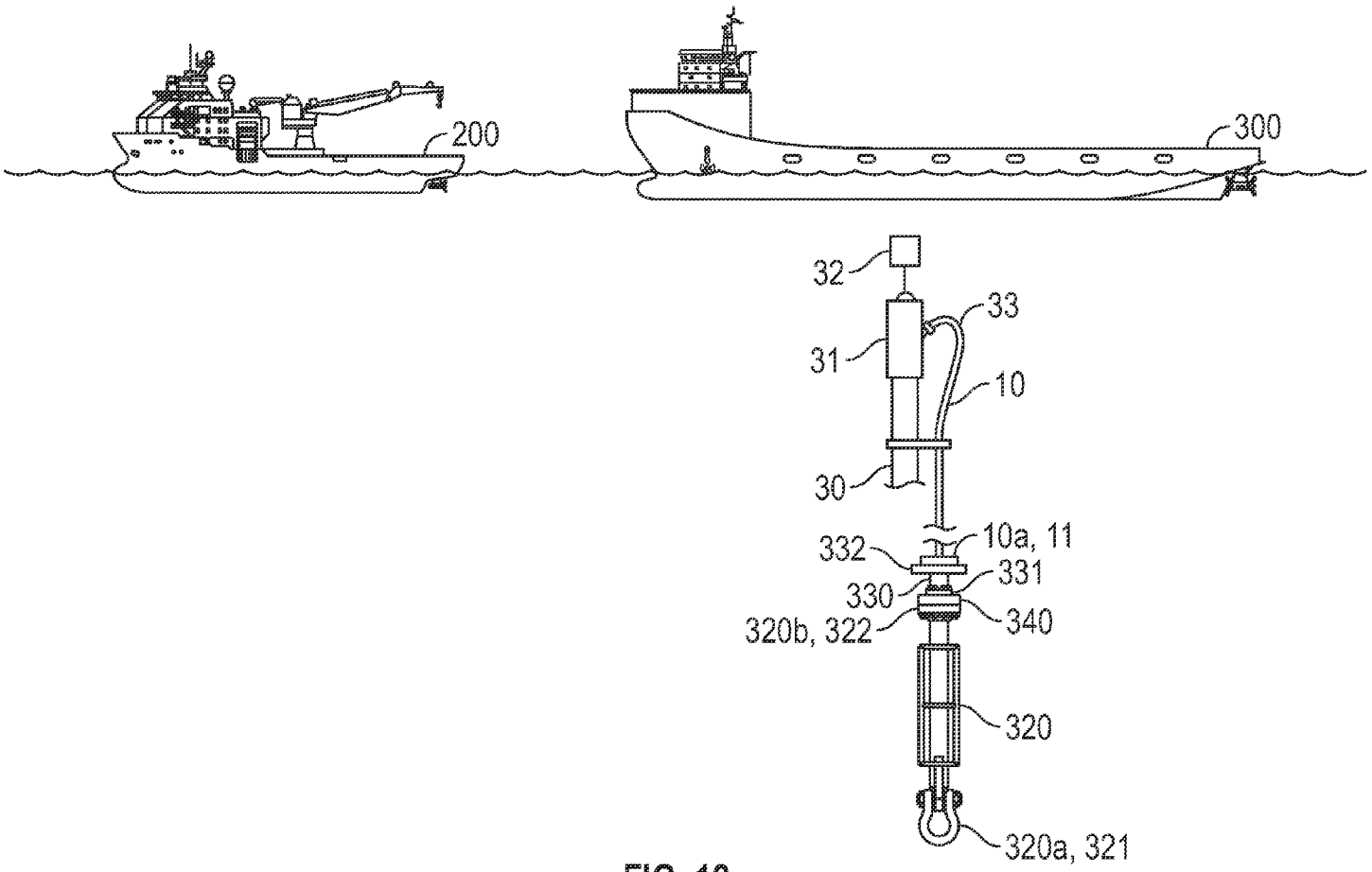
FIG. 12 is a partial schematic view of a free-standing riser and corresponding jumper.

FIGS. 12-15 illustrate sequential views of an embodiment of a method for assembling system 100 on platform 210 over moonpool 204. In FIG. 12, a rigid free standing riser (FSR) 30 and flexible jumper 10 coupled thereto is shown; in FIGS. 13 and 14, the free end of jumper 10 is shown raised to and supported by platform 210; in FIG. 15, LVA 160 is shown connected to jumper 10 on platform 210; and in FIG. 16, UVA 110 is shown connected to LVA 160 on platform 210.

Referring first to FIG. 12, vessel 200 previously described is shown moving towards a second vessel 300 such as a floating production, storage, and offloading (FPSO) vessel. Vessel 200 carries the components of system 100 as well as the hardware to deploy, operate, and retrieve system 100. Hydrocarbons received by vessel 200 may be processed and stored on vessel 200 and/or transferred to vessel 300 for processing or storage. FSR 30 includes an upper riser assembly 31, a buoyancy element 32 coupled to assembly 31, and a gooseneck 33 extending from assembly 31. Flexible jumper 10 previously described is connected to gooseneck 32 and is clamped alongside riser 30. In this embodiment, the free end 10*a* of jumper 10 comprises a jumper flange 11 that is connected to a landing spool 330. Spool 330 has an annular flange 331 at one end and an annular landing flange 332 at the opposite end connected to flange 11. As will be described in more detail below, during assembly of system 100 and coupling of system 100 to jumper 10, landing flange 332 in seated in receptacle 215 of platform 210. A jumper retrieval tool 320 is coupled to landing spool 330. In this embodiment, retrieval tool 320 is a conventional abandonment and retrieval (ANR) head having a first end 320*a* comprising a shackle 321 and a second end 320*b* comprising an annular flange 322 coupled to flange 331 with an adapter plate 340.

Figure 13:
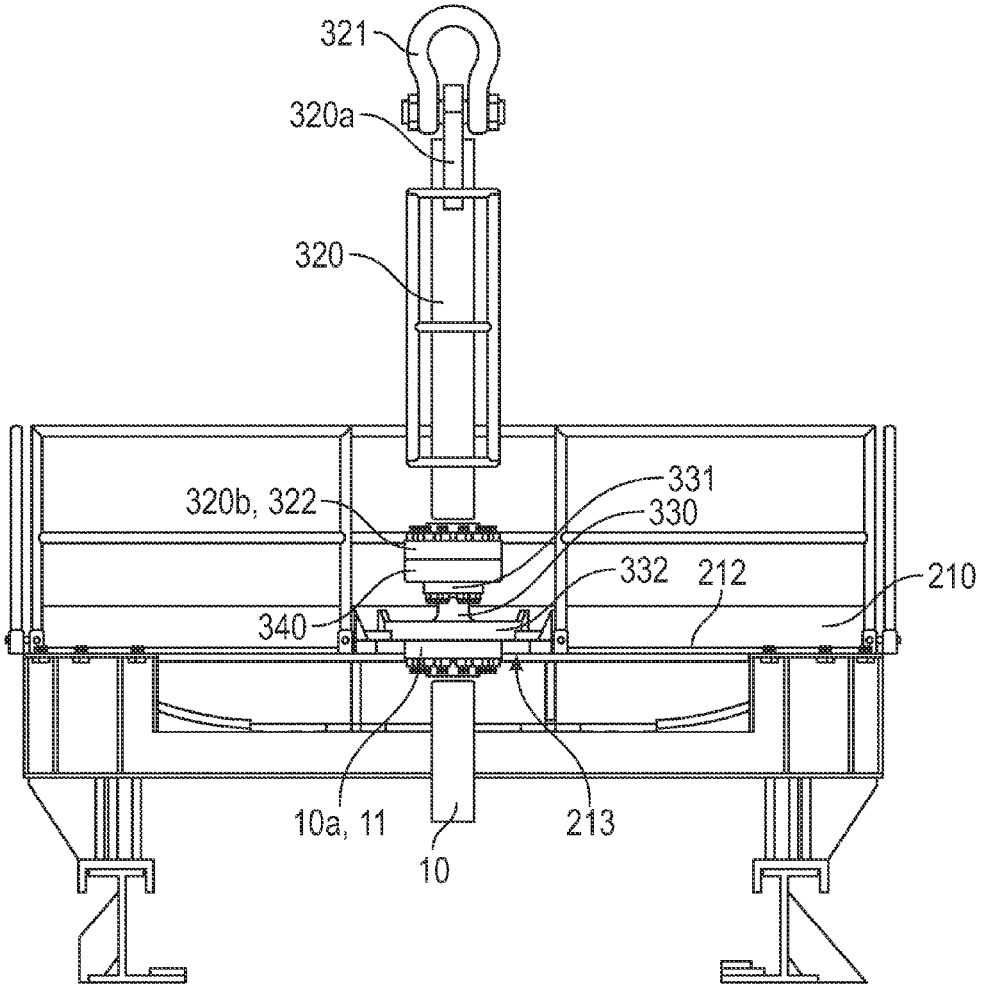
FIGS. 13-16 are sequential schematic illustrations of a method for deploying the fluid transfer system of FIG. 1.

Referring now to FIGS. 12 and 13, to retrieve jumper 10, moonpool 204 is positioned generally over FSR 30 and platform 210 is retracted from moonpool 204. Next, rigging 220 is lowered through moonpool 204 via winch 205 and line 221 to a position proximal retrieval tool 320. One or more subsea ROVs may then grasp tool 320 and connect it to rigging 220 with shackle 321.

Figure 14:
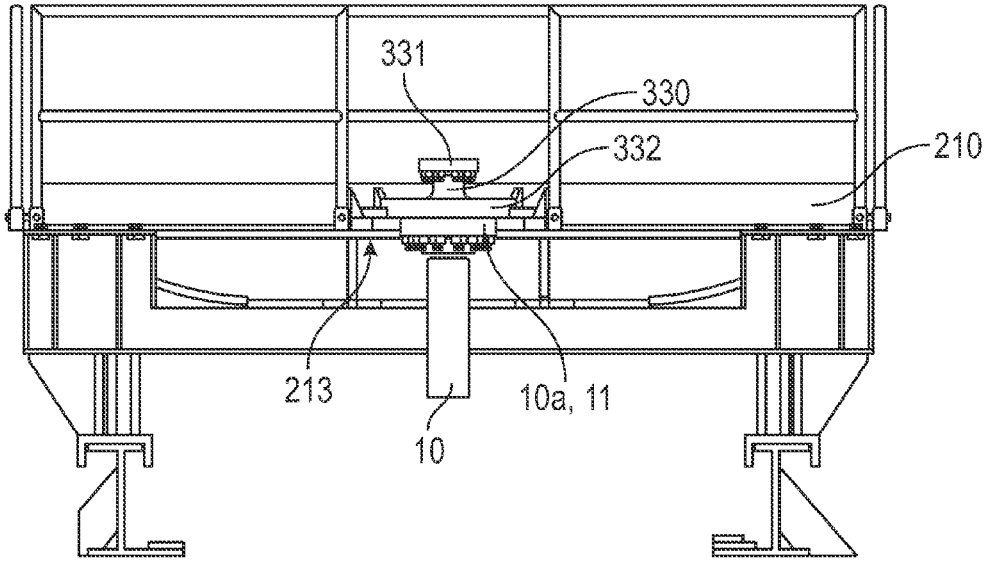

With retrieval tool 320 securely coupled to rigging 220, winch 205 and line 220 lift rigging 220, tool 320, landing spool 330, and jumper end 10*a* upward through moonpool 204 to a height slightly above retracted platform 210. Next, platform 210 is advanced along supports 211 over moonpool 204. Slot 213 is generally aligned with jumper 10 such that jumper 10 is slidingly received by slot 213 as platform 210 advances over moonpool 204. Platform 210 is advanced until jumper 10 extends through the inner terminal end of slot 213. Winch 205 and line 220 then lower rigging 220, tool 320 and landing spool 330 downward until landing flange 332 is seated in receptacle 215 as shown in FIG. 13, thereby transferring the load of jumper 10, tool 320, and landing spool 330 to platform 210. As best shown in FIG. 14, with jumper 10 and landing spool 330 supported by platform 210, retrieval tool 320 and adapter plate 340 are decoupled and removed from landing spool 330 with rigging 220, thereby preparing landing spool 330 for connection to LVA 160.

Figure 15:
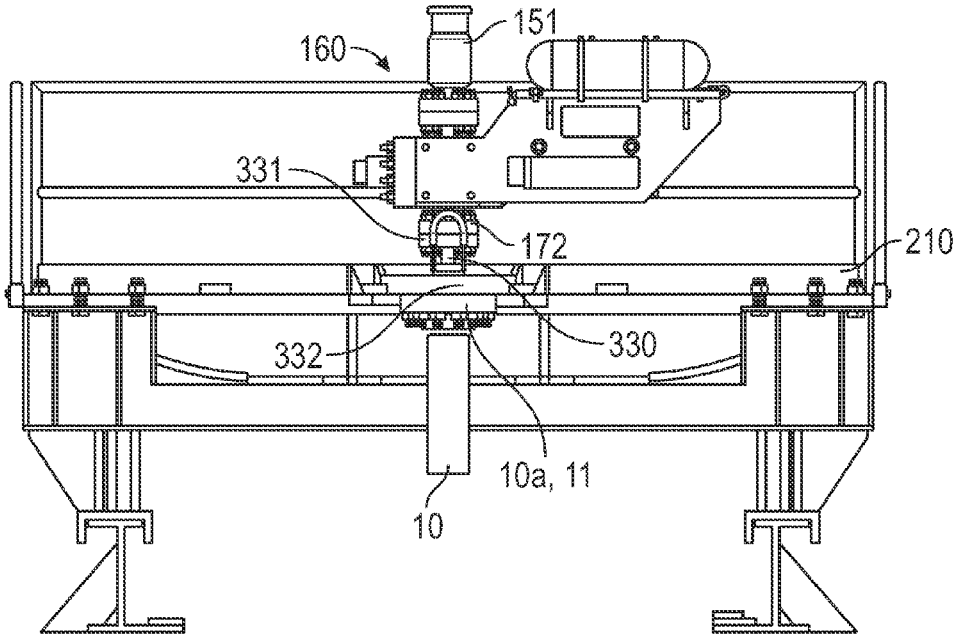

Referring now to FIGS. 14 and 15, LVA 160 is lowered onto landing spool 330 and coupled thereto with mating flanges 172, 331. In this embodiment, LVA 160 is lifted and moved over platform 210 and landing spool 330 with rigging 220 previously described. For example, an adapter comprising a collet connector 152 may be coupled to chain 224 with a shackle, and releasably connected to hub 151 to lift and position LVA 160, and once LVA 160 is secured to spool 330, the collet connector 152 of the adapter may be decoupled and removed from LVA 160, thereby leaving upward facing hub 151 exposed for subsequent connection to collet connector 151.

Figure 16:
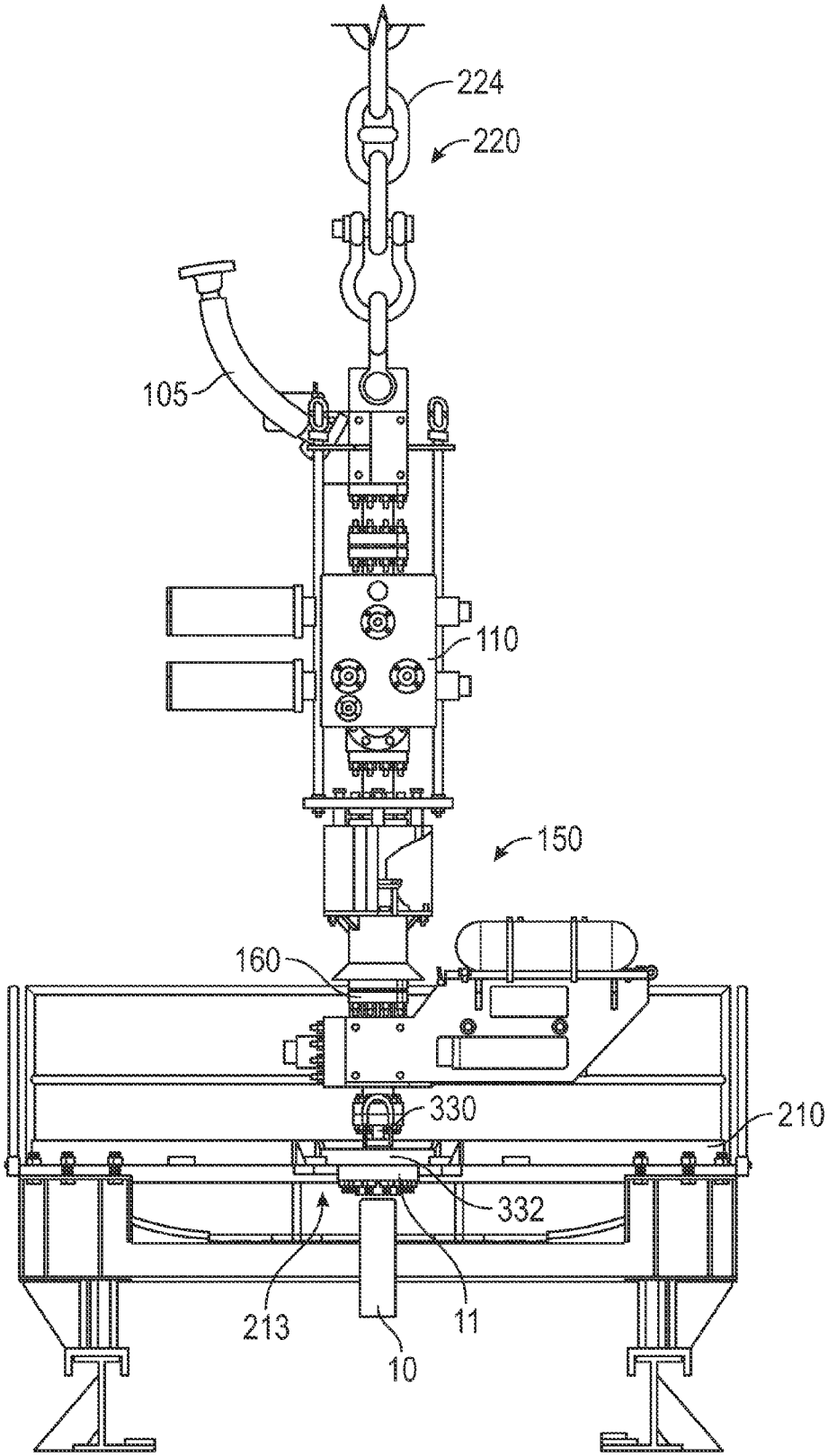

Referring now to FIG. 16, UVA 110 is lowered onto LVA 160 and coupled thereto with collet connector 152, thereby completing the assembly of system 100, which is coupled to jumper 10 extending from platform 210. In this embodiment, UVA 110 is lifted and moved over platform 210 and LVA 160 with rigging 220 previously described. It should be appreciated that hydraulic lines 126 extending from HPU 206 in umbilical 127 are preferably connected to UVA 110 prior to positioning hub 151 within connector 152 so that HPU 206 and corresponding lines 126 may be used to actuate collet connector 152 to engage and lock onto hub 151. Before, during, or after connecting UVA 110 to LVA 160 on platform 210, but preferably prior to subsea deployment, gooseneck 105 is connected to block elbow 112; fluid transfer line 20 is connected to gooseneck 105; and mechanical disconnect rigging 240 is coupled to rods 147.

Next, system 100 is lifted from platform 210 and supported with deployment/retrieval rigging 220 and platform 210 is retracted from moonpool 204 and system 100. Once sufficient clearance between system 100 and platform 210 is achieved, system 100 is lowered with rigging 220 through moonpool 204 into the sea and fluid transfer operations may begin. During such fluid transfer operations, system 100 may be supported by chain 224 and platform 210 as previously described. Namely, once system 100 is disposed at the appropriate depth for fluid transfer operations, platform 210 is advanced over moonpool 204, C-plate 216 is disposed in receptacle 215, and chain 224 is seated in mating recess 218 as shown in FIGS. 8 and 9C, thereby transferring the weight of system 100 to platform 210. Once the load of system 100 is carried by platform 210, line 221 may be disconnected from chain 224 and connected to mechanical disconnect rigging 240 for the remainder of the fluid transfer operations.

In the event that vessel 200 needs to be moved away from FSR 30 (e.g., in anticipation of a hurricane), UVA 110 can be disconnected from LVA 160 by actuating collet connector 152 to release hub 151. As previously described, collet connector 152 may be actuated to release hub 151 hydraulically via lines 126 or mechanically with rigging 240. Once connector 152 releases hub 151, UVA 110 may be retrieved to platform 210 and vessel 200 with rigging 220, and LVA 160 is free to fall under its own weight. As UVA 110 and LVA 160 separate, hydraulic lines 126 connected to actuator 124 of LVA 160 are severed with system 180. However, LVA 160 does not fall to the sea floor as it is coupled to jumper 10, which in combination with FSR 30, supports the weight of LVA 160. Upon disconnection of UVA 110 and LVA 160, and cutting of lines 126, fail-close valve 123 of LVA 160 is biased closed, thereby restricting and/or preventing leakage of hydrocarbon fluids in the surrounding sea. In addition, closure of valves 123 of UVA 110 restrict and/or prevent the leakage of hydrocarbon fluids in transfer line 20. To resume fluid transfer operations, moonpool 204 is positioned generally over FSR 30 and platform 210 is retracted from moonpool 204. Next, rigging 220 is lowered through moonpool 204 via winch 205 and line 221 to a position proximal the subsea LVA 160 coupled to jumper 10. Rigging 220 is then connected to LVA 160 and used to pull LVA 160 through moonpool 204. One or more subsea ROVs may facilitate the subsea connection of LVA 160 and rigging 220. Platform 210 is then advanced over moonpool 204 generally below LVA 160 and landing spool 330 coupled thereto, and LVA 160 is lowered with rigging 220 to seat landing flange 332 in receptacle 215. Next, UVA 110 is mounted to LVA 160 on platform 210 with hub 151 and collet connector 152 as previously described. With system 100 fully assembly on platform 210, it may be deployed subsea in the same manner as previously described.

Figure 17:
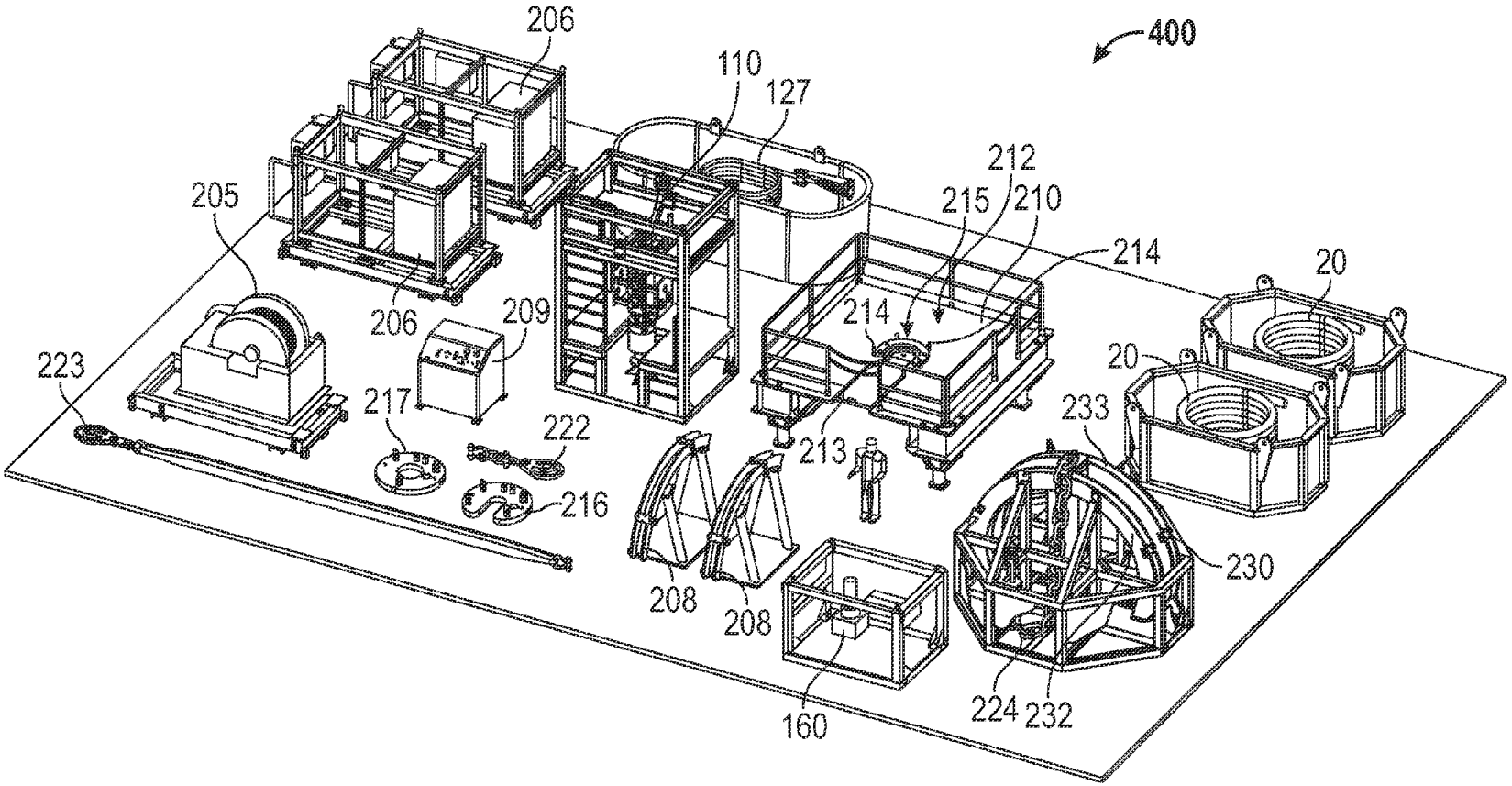
FIG. 17 is a perspective view of an embodiment of a kit for transferring fluids from a subsea conduit or component.

Referring now to FIG. 17, the various components of fluid transfer system 100 and related hardware necessary for deployment of system 100 are preferably stored and inventoried together for ease of transportation and storage. In this embodiment, a kit 400 for rapidly deploying system 100 includes UVA 110, LVA 160, winch 205 and associated line 221, platform 210, C-plate 216, rotary table support plate 217 for coupling sheave 223 to upper deck 203, deck sheave 222, suspended sheave 223 and corresponding suspension line(s), support assembly 230 mounted to chain 224, deck saddles 208, two HPUs 206, umbilical 127 and associated hydraulic lines 126, fluid transfer lines 20, and hydraulic control system 209. HPUs 206 can provide power to assemble and install the various components of kit 400. Consequently, kit 400 may be described as self contained, which enhances the versatility and interchangeability of kit 400 for use on a variety of different vessels. Additional equipment may also be included in kit 400 including, without limitation, rigging equipment and tools (e.g., shackles, crank bars, crow bars, U-bolts, chains, fasteners, and the like), mechanical disconnect rigging 240, etc. Certain components may be packaged within kit 400. For example, in this embodiment, LVA 160, UVA 110, and support assembly 230 are each housed in a transport and installation aid frame, and transfer line 20 and umbilical 127 are each housed in a transport basket.

In the manner described, embodiments described herein may be used to establish, disconnect, and re-establish fluid flow from a subsea free standing riser. The disclosed fluid transfer systems and methods provide a manageable and controllable connection between a subsurface delivery system containing hydrocarbon fluids (e.g., FSR 30) and a surface containment or process vessel (e.g., vessel 200), while providing emergency shutdown capabilities. Consequently, embodiments described herein may be particularly useful in environments where extreme weather patterns may limit the ability of a surface vessel to remain on site, or where the surface vessel itself encounters an emergency situation requiring it to depart the field in a relatively short time period. In addition, the disconnect capabilities described herein offer the potential to safely contain and isolate the hydrocarbon fluids in both the FSR coupled to the LVA and the transfer line coupled to the UVA, as well as reduce the amount of time required to disconnect and move away from the connection location. For example, inclusion of connector 150 allows UVA 110 and LVA 160 to be quickly disconnected (hydraulically or mechanically) in less than 90 seconds. In addition, upon disconnection of UVA 110 and LVA 160, the closure of valves 123 restrict and/or prevent the flow of hydrocarbon fluids into the surrounding sea through transfer line 20 and jumper 10, respectively.

Another potential advantage of embodiments described herein is the self-contained design, which may provide interchangeability between vessels and rapid deployment and recovery. For example, although system 100 and kit 400 are described as being stored and deployed from a drilling ship, in general, system 100 and kit 400 may be stored and deployed form any offshore vessel such as an offshore platform or other type of ship. As another example, system 10 and kit 400 may be transported to an offshore vessel, thereby eliminating the need for the offshore vessel to come ashore. Accordingly, embodiments described herein may enhance the operational ability of a number of vessels, which previously, may have had long set-up and dismantle times to operate in a mode of taking hydrocarbons onboard. Moreover, the modular design, compact size, and relatively light weight of system 100 enables it to be rapidly deployed and lifted by conventional cranes commonly disposed on many offshore vessels.

Although system 100 is shown and described in connection with FSR 30, in general, embodiments described herein may be used in connection with other subsea component or device, such as flexible risers, blow out preventers (BOPs), pumps, manifolds, transfer pipelines, lower marine riser packages (LMRPs), lower riser assemblies (LRAs), upper riser assemblies (URAs), and the like. Although deployment of fluid transfer system 100 is facilitated with one or more subsea ROVs, in general, any suitable underwater vehicle (e.g., ROVs, autonomous underwater vehicles, submarines, and the like) may be utilized. Further, although system 100 is shown and described as producing hydrocarbon fluids from FSR 30 to vessel 200, system 100 may also be used to transfer fluids from a vessel (e.g., vessel 200) to a subsea component (e.g., FSR 30).

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A system for transferring fluids from a free-standing riser to a surface vessel, the system comprising:

a first valve assembly including a first valve spool having an upper end, a lower end opposite the upper end, a flow bore extending between the upper end and the lower end, and a first isolation valve configured to control the flow of fluids through the flow bore of the first valve spool, wherein the flow bore of the first valve spool has an outlet at the upper end configured to supply fluids to the surface vessel and an inlet at the lower end;

a second valve assembly releasably coupled to the first valve assembly with a hydraulically actuated connector, wherein the second valve assembly includes a second valve spool having an upper end, a lower end opposite the upper end, a flow bore extending between the upper end and the lower end, and a second isolation valve configured to control the flow of fluids through the flow bore of the second valve spool, wherein the flow bore of the second valve spool has an outlet at the upper end and an inlet at the lower end configured to receive fluids from the free-standing riser;

a deployment/retrieval rigging coupled to the first valve assembly and configured to suspend the first valve assembly and the second valve assembly from the surface vessel;

wherein the flow bore of the second valve spool is in fluid communication with the flow bore of the first valve spool;

wherein each isolation valve has an open position allowing fluid flow therethrough and a closed position restricting fluid flow therethrough, wherein each isolation valve is biased to the closed position.

2. The system of claim 1, wherein the first isolation valve and the second isolation valve are both hydraulically actuated valves.

3. The system of claim 1, wherein the first valve spool includes a third isolation valve adjacent the first isolation valve, wherein the third isolation valve is configured to control the flow of fluids through the flow bore of the first valve spool.

4. The system of claim 1, further comprising a fluid transfer line coupled to the upper end of the first valve spool and in fluid communication with the flow bore of the first valve spool, wherein the fluid transfer line is configured to transfer fluids between the first valve assembly and the surface vessel.

5. The system of claim 1, wherein the hydraulically actuated connector comprises a hydraulically actuated collet connector coupled to the lower end of the first valve spool and a mating hub coupled to the upper end of the second valve spool.

6. The system of claim 5, further comprising a mechanical release system configured to mechanically disconnect the collet connector from the hub.

7. The system of claim 6, wherein the mechanical release system includes a release plate and at least one rod, wherein the release plate is coupled to a plurality of release pins extending from the collet connector and the at least one rod.

8. The system of claim 1, wherein the first valve assembly includes a first hydraulic actuator coupled to the first valve spool and configured to transition the first isolation valve to the open position; and wherein the second valve assembly includes a second hydraulic actuator coupled to the second valve spool and configured to transition the second isolation valve to the open position.

9. The system of claim 8, wherein the second valve assembly includes a valve actuation assist assembly coupled to the second valve spool and configured to provide hydraulic power to transition the second isolation valve to the closed position.

10. The system of claim 8, further comprising a hydraulic line severing system configured to sever one or more hydraulic lines connected to the second hydraulic actuator upon disconnection of the upper valve assembly from the lower valve assembly.

11. A system for transferring fluids from a free-standing riser to a surface vessel, the system comprising;

a first valve assembly including a first valve spool having an upper end, a lower end opposite the upper end, a flow bore extending between the upper end and the lower end, and a first isolation valve configured to control the flow of fluids through the flow bore of the first valve spool, wherein the flow bore of the first valve spool has an outlet at the upper end configured to supply fluids to the surface vessel and an inlet at the lower end;

a second valve assembly releasably coupled to the first valve assembly with a hydraulically actuated connector, wherein the second valve assembly includes a second valve spool having an upper end, a lower end opposite the upper end, a flow bore extending between the upper end and the lower end, and a second isolation valve configured to control the flow of fluids through the flow bore of the second valve spool, wherein the flow bore of the second valve spool has an outlet at the upper end and an inlet at the lower end configured to receive fluids from the free-standing riser;

a deployment/retrieval rigging coupled to the first valve assembly and configured to suspend the first valve assembly and the second valve assembly from the surface vessel;

wherein the flow bore of the second valve spool is in fluid communication with the flow bore of the first valve spool;

wherein each isolation valve has an open position allowing fluid flow therethrough and a closed position restricting fluid flow therethrough, wherein each isolation valve is biased to the closed position;

wherein the first valve assembly includes a first hydraulic actuator coupled to the first valve spool and configured to transition the first isolation valve to the open position;

wherein the second valve assembly includes a second hydraulic actuator coupled to the second valve spool and configured to transition the second isolation valve to the open position; and a hydraulic line severing system configured to sever or more hydraulic lines connected to the second hydraulic actuator upon disconnection of the upper valve assembly from the lower valve assembly, wherein the hydraulic line severing system includes an outer housing coupled to the upper valve assembly and a cutting member coupled to the lower valve assembly and slidingly disposed in a receptacle of the housing;

wherein the housing includes a plurality of windows extending therethrough and configured to receive the hydraulic lines;

wherein the cutting member includes a plurality of windows extending therethrough and configured to receive the hydraulic lines; and wherein each window of the cutting member has an upper edge comprising a blade configured to cut the one or more hydraulic lines extending therethrough.

12. A method comprising:

(a) assembling a fluid transfer system on a surface vessel, wherein the fluid transfer system includes a first valve assembly including a first valve spool with a hydraulically actuated first isolation valve and a second valve assembly releasably coupled to the first valve assembly with a hydraulically actuated connector, wherein the second valve assembly includes a second valve spool with a second hydraulically actuated isolation valve;

(b) coupling a fluid transfer line extending from the vessel to the fluid transfer system;

(c) coupling the fluid transfer system to a jumper extending from a free-standing riser;

(d) lowering the fluid transfer system through a moonpool in the surface vessel into the sea;

(e) flowing hydrocarbon fluids from the free-standing riser through the jumper to the fluid transfer system, and then from the fluid transfer system through the fluid transfer line to the vessel.

13. The method of claim 12, wherein (c) is performed before (d).

14. The method of claim 12, wherein (a) comprises:

(a1) positioning the second valve assembly on a platform moveably coupled to the vessel;

(a2) coupling the first valve assembly to the second valve assembly on the platform with the hydraulically actuated connector.

15. The method of claim 14, wherein (c) comprises:

(c1) positioning the platform over the moonpool;

(c2) lifting a free end of the jumper to the platform;

(c3) coupling the jumper to the second valve assembly during (a1).

16. The method of claim 15, wherein (d) comprises:

(d1) coupling a deployment/retrieval rigging to the fluid transfer system;

(d2) lifting the fluid transfer system from the platform with the deployment/retrieval rigging;

(d3) retracting the platform;

(d4) lowering the fluid transfer system through the moonpool with the deployment/retrieval rigging.

17. The method of claim 12, further comprising:

(f) hydraulically actuating the connector to disconnect the first valve assembly from the second valve assembly subsea after (e).

18. The method of claim 17, further comprising:

(g) lifting the first valve assembly through the moonpool after (f).

19. The method of claim 18, further comprising:

(h) cutting one or more hydraulic lines connected to the second valve assembly during (g).

20. A system for producing fluids from a subsea source to a surface vessel having a deck, the system comprising:

a platform configured to be moveably coupled to the deck of the vessel;

a fluid transfer system configured to be suspended from the vessel with a deployment/retrieval rigging, wherein the fluid transfer system includes:

a first valve assembly including a first valve spool with a first isolation valve;

a second valve assembly releasably coupled to the first valve assembly with a hydraulically actuated connector, wherein the second valve assembly includes a second valve spool with a second isolation valve;

wherein the hydraulically actuated connector includes a hydraulically actuated collet connector coupled to the first valve assembly and a matin hub coupled to the second valve assembly; and a mechanical release system including a release plate and at least one rod, wherein the release plate is coupled to a plurality of release pins extending from the collet connector and the at least one rod;

wherein each isolation valve has an open position allowing fluid flow through the valve assembly and a closed position restricting fluid flow through the valve assembly;

a disconnect rigging coupled to the hydraulically actuated connector, wherein the disconnect rigging is coupled to the release plate of the mechanical release system and is configured to pull the release plate to mechanically disconnect the first valve assembly from the second valve assembly;

an umbilical including a plurality of hydraulic lines extending from the vessel to the fluid transfer system;

a fluid transfer line extending from the vessel to the fluid transfer system.

21. The system of claim 20, wherein each isolation valve is a hydraulically actuated valve.

22. The system of claim 20, wherein the valve assembly includes a third isolation valve adjacent the first isolation valve.

23. The system of claim 20, wherein the first valve assembly includes a first hydraulic actuator configured to transition the first isolation valve to the open position; and wherein the second valve assembly includes a second hydraulic actuator configured to transition the second isolation valve to the open position.

24. The system of claim 23, wherein the second valve assembly includes a valve actuation assist assembly configured to provide hydraulic power to transitions the second isolation valve to the closed position.

25. The system of claim 24, further comprising a landing spool coupled to the second valve assembly and configured to be coupled to a jumper extending from a free-standing riser, wherein the landing spool includes a landing flange configured to engage the platform.

26. The system of claim 20, wherein the deployment/retrieval rigging includes a winch, a cable extending from the winch over a sheave, and a chain coupled to the cable.

27. The system of claim 20, further comprising a support assembly mounted to the chain, wherein the support assembly includes a first arcuate support member that supports the umbilical and a second arcuate support member that supports the fluid transfer line.

* * * * *